US006090027A

United States Patent [19]

Brinkman

[11] Patent Number: 6,090,027

[45] Date of Patent: Jul. 18, 2000

[54] METHOD FOR PARCEL MARKING AND THREE DIMENSIONAL LABEL THEREOF

[76] Inventor: Tom Brinkman, 1573 N. Tenth Ave., Pensacola, Fla. 32503

[21] Appl. No.: 09/110,066

[22] Filed: Jul. 3, 1998

Related U.S. Application Data

[63] Continuation-in-part of application No. 08/957,238, Oct. 24, 1997.

[51] Int. Cl.[7] ..... B31B 1/88

[52] U.S. Cl. ..... 493/54; 493/55; 493/320; 493/325; 53/411; 156/DIG. 4

[58] Field of Search ..... 493/55, 58, 84, 493/375, 374, 379, 54, 325, 324, 320, 961, 11, 8; 156/DIG. 4, DIG. 3, DIG. 46, DIG. 45; 383/41; 53/511, 412, 410

[56] References Cited

U.S. PATENT DOCUMENTS

| | | | |
|---|---|---|---|
| Re. 21,706 | 2/1941 | Claff | 493/55 |
| 3,916,160 | 10/1975 | Russo et al. | 235/61.12 |
| 3,983,795 | 10/1976 | Bode | 493/55 |
| 4,204,639 | 5/1980 | Barber et al. | 235/462 |
| 4,545,780 | 10/1985 | Martin | 493/55 |
| 4,551,373 | 11/1985 | Conlon | 426/43 |
| 5,384,177 | 1/1995 | Rissmann | 493/58 |
| 5,789,049 | 8/1998 | Randles | 426/40.1 |

*Primary Examiner*—Stephen F. Gerrity
*Assistant Examiner*—Sam Tawfik
*Attorney, Agent, or Firm*—Leonard Heyman

[57] ABSTRACT

A method of marking a parcel (68) includes folding a label (33) about a chosen corner (123) of parcel (68) having contiguous sides (43) and converging edges (44) to permit an individual to rapidly locate the label. The label may be printed in ink and/or embossed directly on a parcel substrate (58) or as a lithographed and/or embossed sheet applied to the parcel substrate during its manufacture.

7 Claims, 23 Drawing Sheets

METHOD FOR PARCEL MARKING AND THREE DIMENSIONAL LABEL THEREOF

RELATED APPLICATION

This application is a Continuation in Part of application Ser. No. 8/957,238 filed Oct. 24, 1997.

BACKGROUND

1. Field of Invention

This invention relates to marking a corner, particularly suited to the purpose of quickly providing and then instantly recognizing an information focal point on a shipping or merchandise parcel.

2. Discussion of Prior Art

The marking of a parcel for shipment or inventory in the past has traditionally involved marking by means of a single label positioned to be visible on one side of a box parcel having six sides. Some labels have more than one portion, or billboard, each serving a different purpose or providing different information. While some attention has been paid to develop multiple billboard designs typically applied to the center of a single side, it has been difficult to quickly locate those labels on the parcel. This is because a parcel's lifecycle presently requires dice-like repeated flipping and rotation of each parcel in the warehouse, transportation vehicle, loading dock, and parcel delivery center. As a parcel continues to move down the belts to be routed onto the proper paths for delivery trucks, and then into warehouses after delivery, a parcel will continue to require the same repetitious and repeated rotational labor to find the label which indicates its direction, urgency, and/or contents. For some time now, manufacturers and parcel shippers have allowed random placement of labels.

Currently, time-critical information markings, such as delivery urgency, as well as markings regarding shelf life, are frequently positioned indiscriminately rather than purposefully, or are difficult to understand by consumers or other inexperienced persons having a need to know.

Several types of labels attempting to use a central location having multiple purpose panels or billboard panels have been proposed, but they all suffer disadvantages. For example, U.S. Pat. No. 5,484,170 to Raymond Hatfield (Jan. 16, 1996) shows a four-billboard panel design collecting the various information in one area of the parcel in a linear format. However, since this label is applied only to one side of a parcel, it doesn't solve the problem of having to search for the label if the parcel does not happen to be oriented with the side having the label facing you.

U.S. Pat. No. 5,484,168 to Chigot (Jan. 16, 1996) shows a label with a peel-off face allowing for a signature that may be needed for the receiving the parcel. This label is also applied to one side of a parcel, and so suffers from the same problems as the Hatfield label mentioned above.

U.S. Pat. No. 5,417,457 to Reinhardt (May 23, 1995) shows an indexing and organizing system for video tape cases and/or compact audio/video disc. The system provides a self-adhesive label to be applied from one side and over two edges of a storage case. This is inadequate for shipping.

U.S. Pat. No. 5,421,778 to L. Kouramanis (Jun. 6, 1995) shows a "Cash on Delivery" (COD) label with an envelope that is Z-folded to provide a plurality of panels by stacking one billboard on top of itself. This label is also applied on only one side of a parcel and so suffers from the problems of Chigot and Hatfield above.

U.S. Pat. No. 5,098,129 to R. Haber (Mar. 24, 1992) shows two business cards joined on a common edge by a perforation line, one or both having peelable backing removable to expose adhesive. In use, one business card has its adhesive exposed and is applied to a catalog or paper, while the other can be removed by a recipient by tearing along the perforated line and carried in a wallet or applied to a telephone-file card. Haber does not show applying the card to two or more sides of an article or parcel, and provides only two billboards with only one fold line between them, and so is not particularly suited for application to a parcel corner having at least two converging edges.

U.S. Pat. No. 5,031,939 to S. Webendorfer et Al. (Jul. 16, 1991) shows a combination of address and multiple price labels in a one multi-part form. The multiple price labels are folded under the address portion during shipping, and the recipient then tears the shipping label along perforated lines 66 to expose the price labels so that they may be separated and applied to the retail items shipped in the parcel. Two such labels are provided on each page using a non-impact printer such as a sheet-fed laser printer, and are held together only by the peel-away backing. The labels are identical and mark only one side of a parcel, resulting in the same problems discussed above with reference to the Hatfield patent.

U.S. Pat. No. 5,071,167 to Sean O'Brien (Dec. 10, 1991) shows a three-billboard panel design that is compressed in a Z-folded or accordion-like manner. Applied as a single address label, one must remove the top or address label billboard segment to access a second billboard hidden beneath it. The label is applied on only one side of a parcel and again results in the problems discussed above with reference to the Hatfield patent.

U.S. Pat. No. D322, 815 to P. J. Gollon (Dec. 31, 1991) shows a computer-printed form- or tractor-fed label having fold lines and a spike of the same substrate for inserting in the ground. This label is not suitable for marking parcels due to its irregular shape. Furthermore, the patent shows the label portion which folds against itself leaving no substantial area with exposed adhesive for applying the label to a parcel or other article.

U.S. Pat. No. 4,787,158 to M. Vitol (Nov. 29, 1988) shows a tamper resistant retail price label having a slit dividing the price label into two portions. Reapplication of this label by an unscrupulous consumer desiring to swap labels would require a careful alignment. The patent does not teach applying the label to multiple contiguous sides of a parcel, and the slit extends all the way through the label making application of the label onto a corner of a parcel difficult without separating the portions. Furthermore, the label disclosed is too small to contain useful address, contents, or urgency information.

U.S. Pat. No. 4,637,633 to David Instance (Jan. 20, 1987) shows an information sheet folded into an envelope to protect the information printed thereon, such as instructions for assembling the product to which the envelope is attached. This envelope is not well suited for attaching to a parcel for shipment, since viewing the information would require the separation of the information sheet from the envelope structure along tear-line 24 (see col. 24, lines 50–55) and shipping labels require that the information be visible, accessible, and available at numerous points along its journey. Additionally, since the label/envelope adheres only to one side of an article, it suffers from the same problem as discussed above with reference to the Hatfield patent.

U.S. Pat. No. 4,708,368 to David Instance (Nov. 24, 1987) shows a four-billboard design that Z-folds its billboard segments appearing to be a single address label on a parcel. As in Instance's prior patent discussed in the previous paragraph, the hidden billboards are not useful during shipment, and since the label is applied only to a single side of the package, it suffers from the same problem discussed above with reference to Hatfield.

U.S. Pat. No. 4,338,155 to Buchele (Jul. 6, 1982) shows an indexing device for applying a label to a container. The label is applied to a six-sided bottle in a consistent position. The label disclosed extends over an irregular surface, but is not shown applied to a corner formed from at least two converging edges.

U.S. Pat. Nos. 4,204,639 and 4,240,848 to Barber et al. (May 27, 1980) and Barber (Dec. 23, 1980), respectively, show a label folded over a file folder or add-on tab appearing on a single edge of the folder substrate. The labels include 3 billboards all in a single row, and is therefore not adapted to mark the corner of a parcel having at least two converging edges.

U.S. Pat. No. D245, 290 to Kingsford (Aug. 2, 1977) shows a die-cut sign having fold lines that enable it to stand erect on a flat horizontal surface. This sign would be unsuitable for use as a parcel label since it would easily be damaged or torn off during shipping.

U.S. Pat. No. 3,946,507 to Fergg et al. (Mar. 30, 1976) shows a folding rectangular label having two slits for positioning on an envelope edge so that a central portion between the slits, which is not provided with adhesive on its back extends upward as an index flag to identify customer negatives or prints contained in the envelope. As in the patent to Kingsford above, this label would be unsuitable for use as a parcel label because it is prone to being damaged or torn-off during shipment of the parcel.

U.S. Pat. No. 3,916,160 to Russo et al. (Oct. 28, 1975) shows a preprinted circular bar-code label which can be applied to the corner of a package. The label is not suitable as a parcel label because the entire surface of the label is taken up by the bar-code and there is therefore no available space for information relating to the destination, contents, or urgency of the parcel.

Thus, prior-art labels have primarily been designed for application onto the side or edge of a parcel or substrate. Additionally, all current inventory, merchandise, or parcel labels are known to suffer from a number of disadvantages, including wasted time in finding a label on a parcel since traditional shipping labels are visible on only one side of a parcel, friction peeling or rolling of a label off the side of a parcel. Also, the random application of a required hazardous materials or "Fragile" label to a parcel's side, perhaps not adjacent to the address label, will increase likelihood of an accident.

A collage of single labels on a parcel's sides may contain the all the necessary information. However, due to the dice-like flipping and rotating nature of handling a parcel in transit these labels may never be seen. The improper labeling or a failure to see a hazardous contents label can cause dangerous storage conditions. This unacceptable risk may be responsible for causing personal injury, toxic reactions, death, or fire. Prior-art parcel labels featuring multiple billboard segments are designed to only expose only the address. However, persons may need to apply or locate additional information on a parcel. This additional information may be related to: delivery urgency, contents, declared hazardous materials, bar-codes, storage conditions, critical shelf life, green-directions for safe environmental disposal, or time dated materials.

Objects and Advantages

Accordingly, several objects and advantages of the present invention are to provide an improved package label that everyone can quickly find. Some of the benefits of an improved parcel label applied to a parcel corner in accordance with the invention include:

one can quickly find a label on a parcel;

a chosen corner can be marked;

it provides a label that is visible from the sides and edges of a chosen corner;

it provides a label marked corner permitting additional information to be marked next to it;

it provides an information focal point at a central location on a parcel;

it provides a label that wraps a parcel corner and resists a friction peel or roll off;

it provides a three dimensional label that can mark a parcel corner having 1, 2, 3, or 4 printable billboards of information if needed;

it provides for direct printing of a three dimensional label as a corner with ink on a parcel substrate during its manufacture; and it provides a three dimensional label as a molded corner applied to a parcel.

SUMMARY

The invention relates to a method and means of marking parcels or other articles to provide information such as the destination or contents on parcel's the exterior in a manner that is readily available to a person in need of such information. It has heretofore been unrecognized that a label extending around two converging edges of a parcel increases the availability of important label information since it increases the likelihood that the label will be seen and decreases the time it takes to find the label on the parcel. Since the invention results in three sides of a six-sided parcel box or both sides of a two-sided parcel envelope being marked with a single label, the label is easily found and better serves its function to inform individuals of important information related to the parcel.

The label is subdivided into segments, also called "billboards." The term "billboard" is used generally to describe a portion of a label which serves a distinct function or is separated from the rest of the label by one or two fold-lines. Each billboard corresponds to a side of the parcel, although in certain embodiments, more than one billboard is applied to one side of the parcel. The term "information billboard" refers to a segment of sufficient size to provide content, origin, destination, or other useful information about the parcel. The term, "marker billboard" is a segment which can be color-coded or printed with an identifiable pattern, but is generally not of sufficient size to provide complete information about the parcel. The marker billboard can be used to identify which corner of the parcel is marked with a label, and can direct a person to that corner to find the needed information. Preferably, the information sought is obtained from an adjacent information billboard.

The invention consists of a three-dimensional label and a method of applying the label to a parcel. By "three-dimensional," it is meant that the label extends in three directions once applied, and distinguishes it from prior-art two-dimensional labels, which are flat and adhere only to one side of a parcel. The three-dimensional labels are preferably provided with adhesive on the reverse side and a peel-away backing which is removed by the user to expose the adhesive prior to applying the label to the parcel or object to be marked.

There are numerous possibilities associated with the present invention, and they are discussed in conjunction with the various embodiments disclosed. For example, the labels can be provided on continuous tractor-fed computer printer paper or sheet-fed paper for use in a laser printer. Certain embodiments provide the three-dimensional label having four billboards with a slit extending partway through the label between two of the billboards to enable the label to easily wrap around the corner of a parcel. Additional slits can be provided to enable "gyroscopic readability" which means that the label can be positioned in any direction on any corner by using one of four or five slits formed into the label. Alternatively, the label can be provided without slits, but with a V-shaped cut-out so that there is no billboard overlaps another or part of another billboard. The label could instead be provided with one billboard being slightly smaller than an adjacent quadrant so that it can be folded underneath the adjacent billboard during application of the label. On the other hand, an overlapping billboard might be useful as a removable stub for accounting or delivery purposes, and there are embodiments of the invention directed to this idea as well.

BRIEF DESCRIPTION OF DRAWINGS

FIG. 4B' is a perspective view showing the label of FIG. 4B applied to a parcel.

FIG. 4C' is a perspective view showing the label of FIG. 4C applied to a parcel.

FIG. 4D' is a perspective view showing the label of FIG. 4D applied to a parcel.

DETAILED DESCRIPTION OF THE PREFERRED EMBODIMENTS

As will be seen, the invention relates to a method and means of marking parcels or other articles to provide information such as the destination or contents on parcel's the exterior in a manner that is readily available to a person in need of such information. It has heretofore been unrecognized that a label extending around two converging edges of a parcel increases the availability of important label information since it increases the likelihood that the label will be seen and decreases the time it takes to find the label on the parcel.

A typical parcel box has six rectangular sides, twelve edges, and eight corners. A typical parcel envelope is flat, has two rectangular sides, four edges and four corners. The term "rectangular" is used throughout this specification and claims to mean a shape having four sides and four right angles, including squares. In accordance with the present invention, a chosen parcel corner having contiguous sides and two or three converging edges is marked with a three-dimensional label which is applied to the sides of a parcel adjacent a chosen corner and is folded over the converging edges of the parcel which form the corner. The label can be subdivided into segments, also called "billboards." Each segment corresponds to a side of the parcel. The term "information billboard" is a segment of sufficient size to provide content, origin, destination, or other useful information about the parcel. The term, "marker billboard" is a segment which can be color-coded or printed with an identifiable pattern, but is generally not of sufficient size to provide complete information about the parcel. The marker billboard can be used to identify which corner of the parcel is marked with a label, and can direct a person to that corner to find the needed information, for example, from an adjacent information billboard.

The label has a uniquely folded substrate which may be with or without indicia or ink.

The label is folded to attach it to a parcel on the parcel's corner. Also it can be applied as ink directly printed on a parcel substrate or as a molded corner applied to a parcel in order to identify it as the information focal point of a parcel. These and other features of the invention will become clear in the context of the enumerated embodiments below.

Figure 1A:
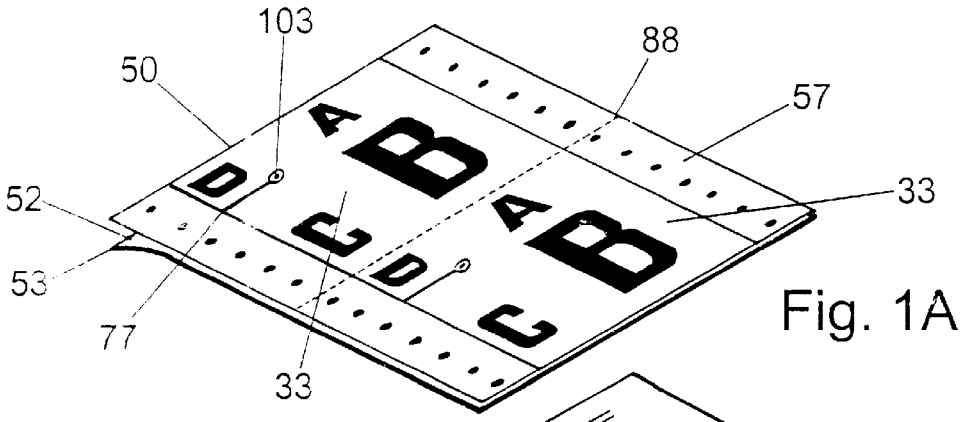
FIG. 1A is a perspective view of a tractor-fed printout of continuous folding three-dimensional labels having a slit in accordance with the invention.
Figure 1B:
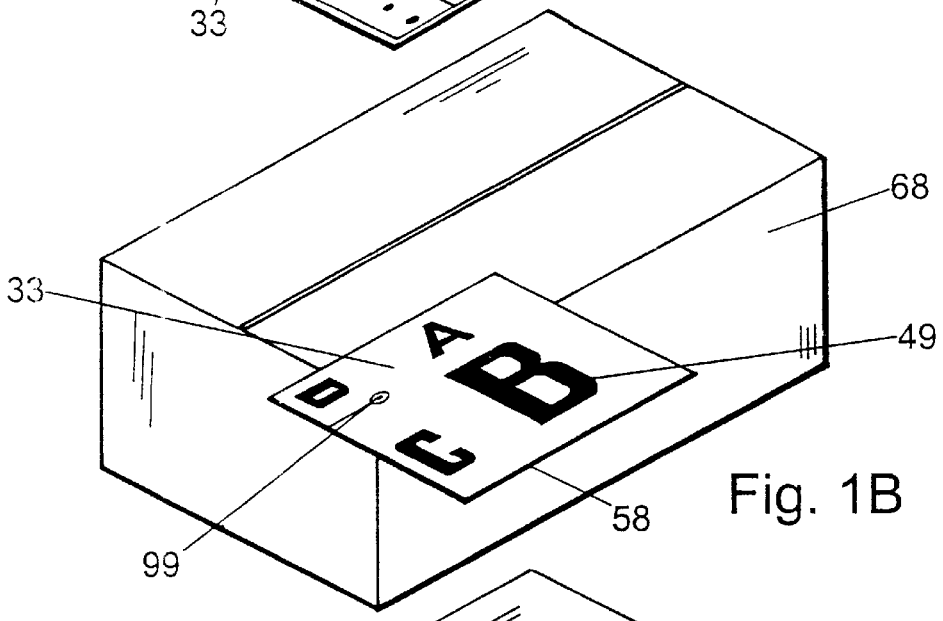
FIG. 1B is a perspective view of one of the labels shown in FIG. 1A initially aligned on a corner of a parcel.
Figure 1C:
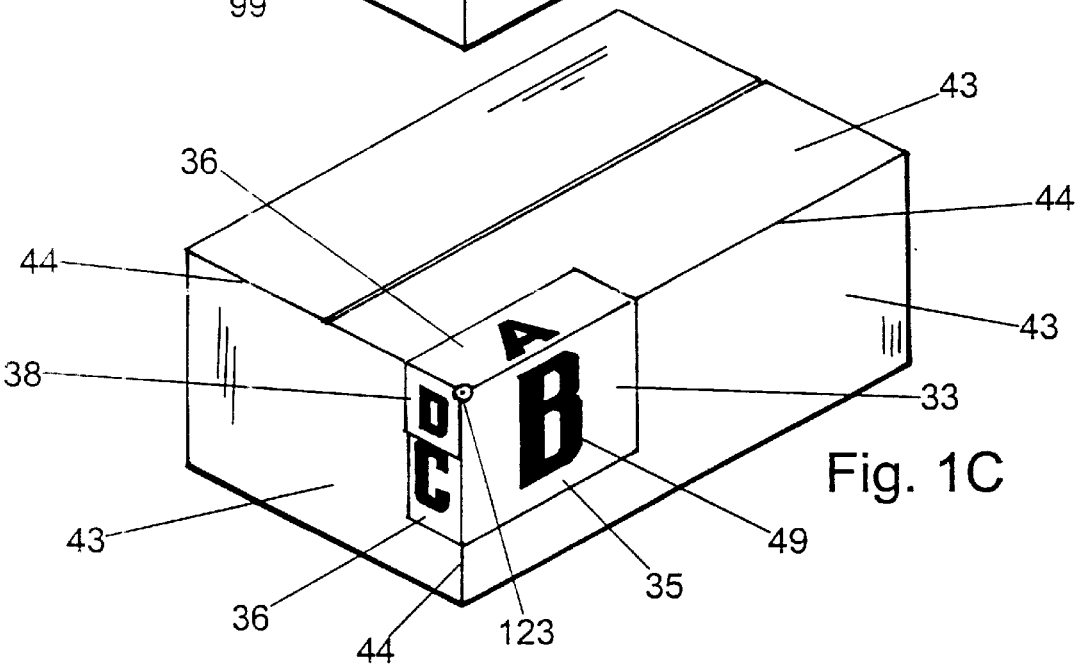
FIG. 1C is a perspective view of the label shown in FIG. 1B applied to the corner of a parcel.

FIGS. 1A–1C—Four Billboard Label with Slit

FIGS. 1A–1C show a first embodiment comprising a computer-printed three-dimensional parcel label or three-dimensional label 33. By "three-dimensional," it is meant that the label extends in three directions once applied, and distinguishes it from prior-art two-dimensional labels, which are flat and adhere only to one side of a parcel. The label shown has four billboard segments: "A", "B", "C", and "D" and a single slit 77. The billboard segments are formed by dividing a label into four portions with an information focal point at the point where all four segments meet. The dividing lines are very much like the "X" and "Y" axis of Cartesian coordinates. As will be seen in relation to FIG. 4A, when designing the label, the information focal point may be skewed anywhere on the label face causing some segment to increase in size and others to become smaller. FIG. 1A illustrates a label having a top of form or gripper 50 used for alignment in the printer prior to printing. This tractor-fed sheet 57 may be marked with programmed fields of information using a computer or it can merely provide a surface on which to write information by hand. FIGS. 1B and 1C illustrate the alignment and application of a three-dimensional parcel label 33 on a chosen parcel corner 99 aligned with the center of a label 103 illustrated with a small target symbol. The alignment will mark and become the information focal point 123 of a parcel for this embodiment.

FIG. 1A shows a three-dimensional label 33 made of continuous tractor-fed stock 57 having one large printable billboard segment "B" with two marker billboard segments marked as "A" and "C". The "D" billboard segment may be removed or folded around to become an overlapping billboard. Label 33 has slit 77 which extends from label center 103 illustrated with a target symbol. A small hole may be punched out at label center 103 for accommodating a parcel's rounded corners or to permit slight mis-alignment of the label center 103 with parcel corner 99 when applying the label to the parcel. As will be discussed with reference to FIG. 4A, placement of label center 103 determines the relative sizes of the billboards. In this example, the label center is placed towards the upper left corner of the label to provide a single information billboard "B" and two marker billboard segments of equal width for a balanced visual result. The three-dimensional label can fed into a printer (not shown) with the top of the form 50 set to apply programmed fields of information as they need to be applied. The three-dimensional label may have a pressure sensitive adhesive 52 and a release backing 53 to allow easy application of label 33 to parcel 68 (shown in FIG. 1B). Center 103 of the label is illustrated by the target symbol. Label 33 is released from other three-dimensional labels in a continuous web tearing at a perforated line 88.

FIG. 1B shows label 33 applied to and aligned with corner 99 of a box parcel 68. At this point an impressionable substrate 58 of the three-dimensional label face has been imprinted with ink 49 or marked otherwise for the purpose of the application to the parcel. In FIG. 1C, label 33 is shown as fully applied to parcel 68 having contiguous sides 43 and converging edges 44 that form an apex on the chosen corner. Information billboard 35 is marked with ink 49 having programmed fields of information. Two marker billboards 36, and a overlapping billboard 38 wrap about the corner of the parcel marking an information focal point of the parcel 123.

FIGS. 2A–2D—Multiple Use Label

FIGS. 2A through 2D illustrate a second embodiment comprising a multi-part form having a duplicate top copy 54 without adhesive and a label copy 33 with adhesive backing 53. Duplicate 54 may be used for accounting purposes and label copy 33 is applied to a parcel document envelope having a corner. The image imprinted on label 33 is transferred from duplicate 54 by means of a carbon sheet (not shown), use of a carbon impregnated paper 55 or other chemically active means known to those in the art. As will be further described with reference to FIGS. 2B, 2C, and 2D below, label 33 is applied to parcel 24 by aligning label center 103 with parcel corner 99, folding label 33 to wrap contiguous sides 43 and converging edges 44 of an envelope parcel to form an information focal point 123 of a parcel 24.

Figure 2A:
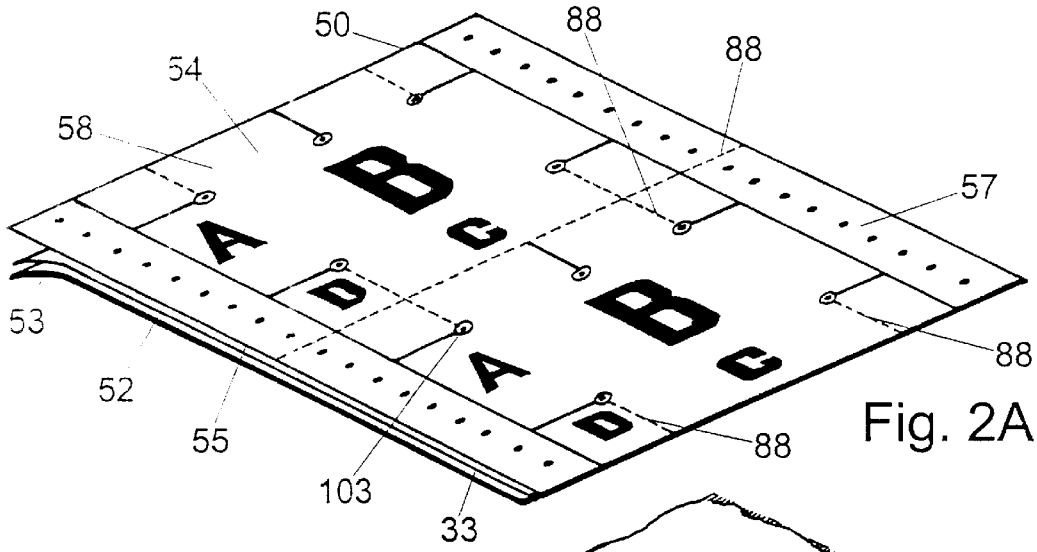
FIG. 2A is a perspective view of a tractor fed printout of multi-part multi-purpose continuous printable forms with carbon-copy, three-dimensional labels having multiple parts and slits, in accordance with the invention.

More particularly, FIG. 2A shows a tractor-fed form 57 having three-dimensional label 33 and a non-adhesive duplicate top copy 54 above label 33. Although the drawings show each sheet separated slightly from the remaining sheets for clarity, in practice all the sheets will be in contact and removably attached by one of the many known means of attaching duplicate sheets. Label 33 is constructed in a typical manner with release backing 53 which is removed to expose adhesive 52. This embodiment shows additionally how a non-adhesive duplicate multiple part 54 may be produced by aligning the top of form 50 when using an impact type of printer and applying the programmed fields of information to the label 33. It may be beneficial for accounting purposes to have a non-adhesive label duplicate 54 printed at the same time that label 33 is printed for parcel marking.

Label 33 in FIG. 2A has a perforated line 88 which allows the removable billboard "D" to be left or removed for accounting purposes or to verify driver delivery of a shipment corresponding to information on an invoice showing date fields or bar coded information. Top copy 54 may be on a impressionable substrate designed to take an impact marking of its surface such as a standard paper infused with a carbon impregnated backing 55. This will allow an image to be transferred to the actual face of label 33 which is designed to be aligned on a parcel corner having first separated the duplicate, disposing of the tractor guides, and a backing release sheet. The creative uses for the duplicate will remain with the needs of the accounting or managerial department of the business involved. Contemplated uses include inserting the duplicate copy into the parcel or simply to sending the duplicate copy as a mailed notification in concert with an actual shipping date of a parcel. Label 33 includes a removable billboard "D" that is perforated or die-cut along line 88 for easy removal of sections on a chosen corner.

Figure 2B:
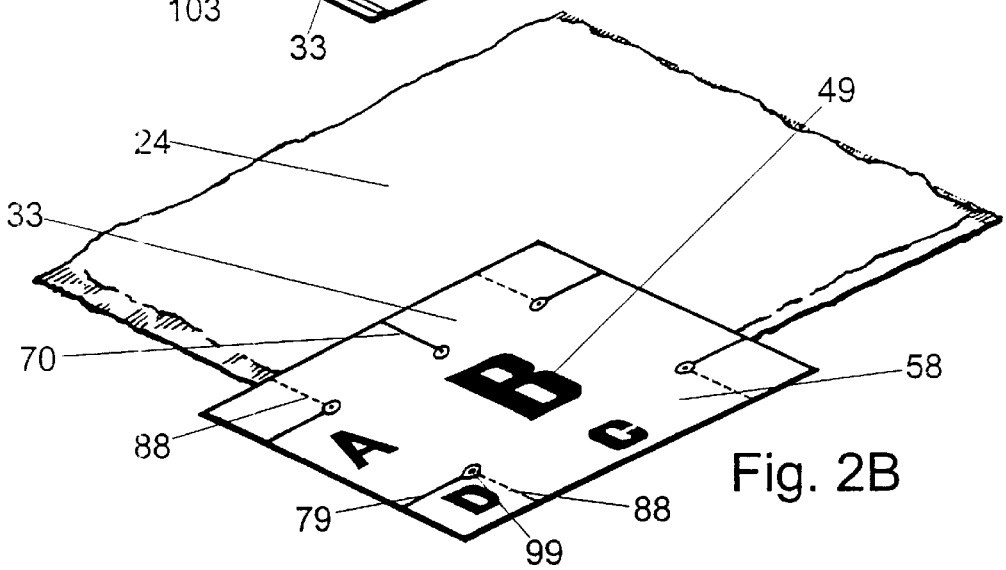
FIG. 2B is a perspective view of one of the multi-purpose three-dimensional labels shown in FIG. 2A having one of its slits aligned to a parcel face.

FIG. 2B shows the alignment of label center 103 on the corner 99 of document envelope parcel 24. However, the design principles ascribed to and shown in FIG. 2B are to make label 33 easily applicable to all parcels, including boxes and envelopes. The orientation of slit 79 shown in FIG. 2B is applied and orientated to the left, or nine o'clock position to prevent or minimize the danger of having the print-head of an impact printer (not shown) snag the three-dimensional label face at the slit. For this reason, it is preferred that the slits in the print areas are all aligned in a horizontal direction to avoid having a print-head repeatedly crossing a vertical slit from the top of the three-dimensional label.

Figure 2C:
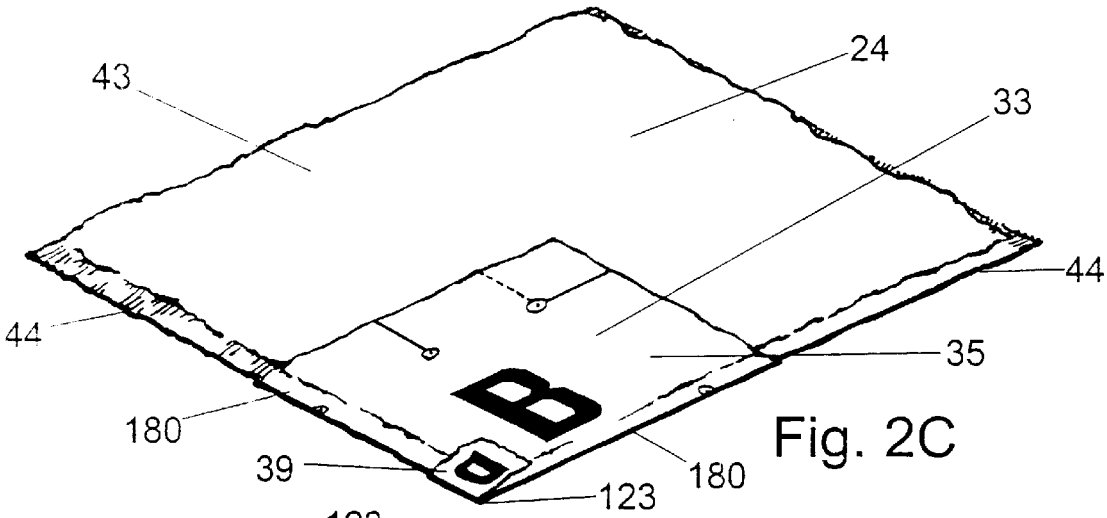
FIG. 2C is a perspective view of the three-dimensional label shown in FIG. 2B applied to the corner of a parcel with marker billboards wrapped over the converging edges at the corner.
Figure 2D:
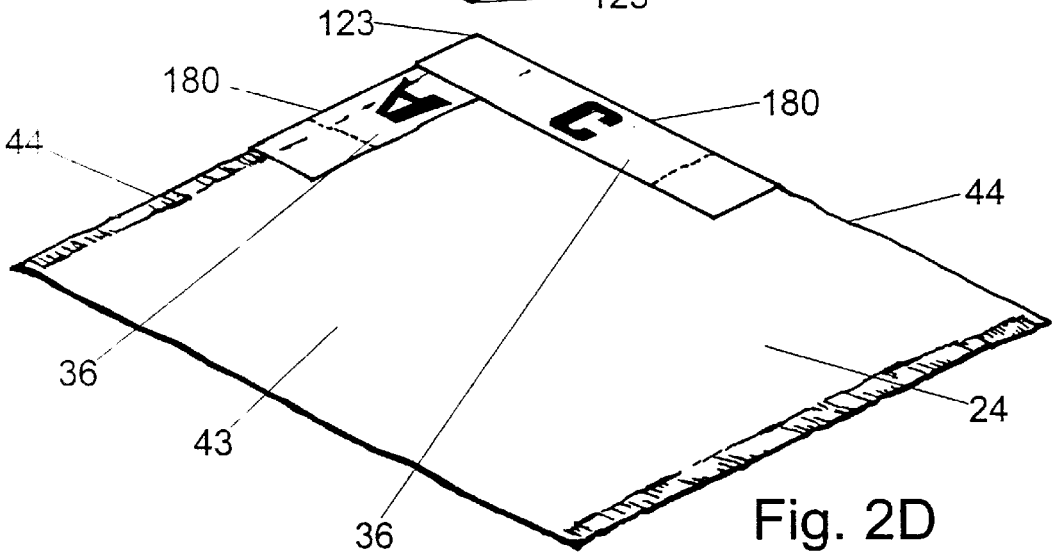
FIG. 2D is a bottom perspective view of the parcel shown in FIG. 2C having the three-dimensional label applied to it.

FIG. 2C shows alignment and application of label 33 to information focal point 123 on envelope parcel 24. Once the protective backing is removed from label 33 it is orientated to be applied to the top contiguous side 43. Marker flaps marked "A" and "C" are wrapped to fold one hundred and eighty degrees around converging edges 44 onto contiguous backside 43 of the envelope parcel as shown in FIG. 2D. Note the difference in how a fourth overlapping flap 39 marked with a "D" folds back over and onto the front side of parcel 24 from the back side of parcel 24 shown in FIG. 2C. Flap 39, if found unattractive, can be torn off, removed by a die-cut section in a custom design, or applied as shown folding on perforation line 88 shown in FIG. 2B. Of particular interest in this illustration is how this fourth billboard, marked with a "D", may become useful as a scanned verification or tracking number that may removed to confirm a delivery. While this embodiment of a three-dimensional label shows one large information billboard 35, all billboards or the entire surface of the three-dimensional label 33 may be printed with information prior to application.

FIG. 2D shows the bottom of parcel 24 shown in FIG. 2C. This view illustrates the directing effect that the marker billboards "A" and "C" can have on finding the information about a parcel by directing a person to simply view the other side. Simply stated, marker billboard flaps 36, marked here with an imprinted "A" and "C", wrap so as to fold 180° around the converging edges 44 of a chosen corner and are then smoothed onto contiguous back side 43 of envelope parcel 24.

Figure 5A:
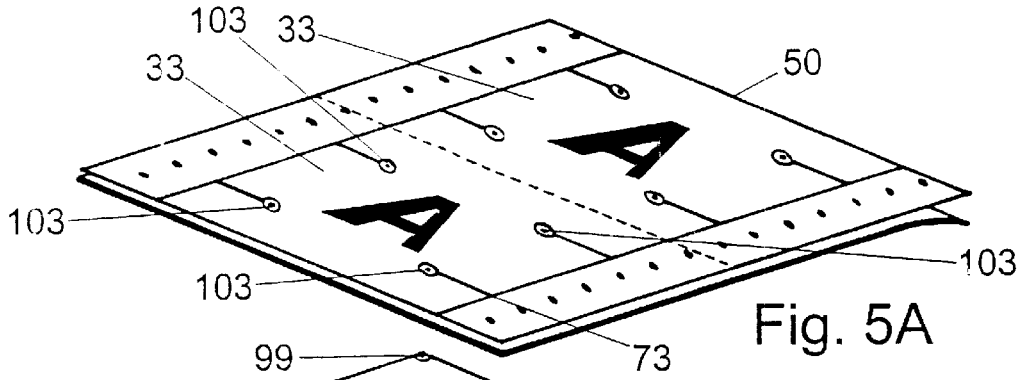
FIG. 5A is a perspective view of tractor-fed three-dimensional labels having multiple slits used to illustrate "gyroscopic-readability" matching all corner slits about the four parcel corners on the top of a box parcel in accordance with the invention.
Figure 5B:
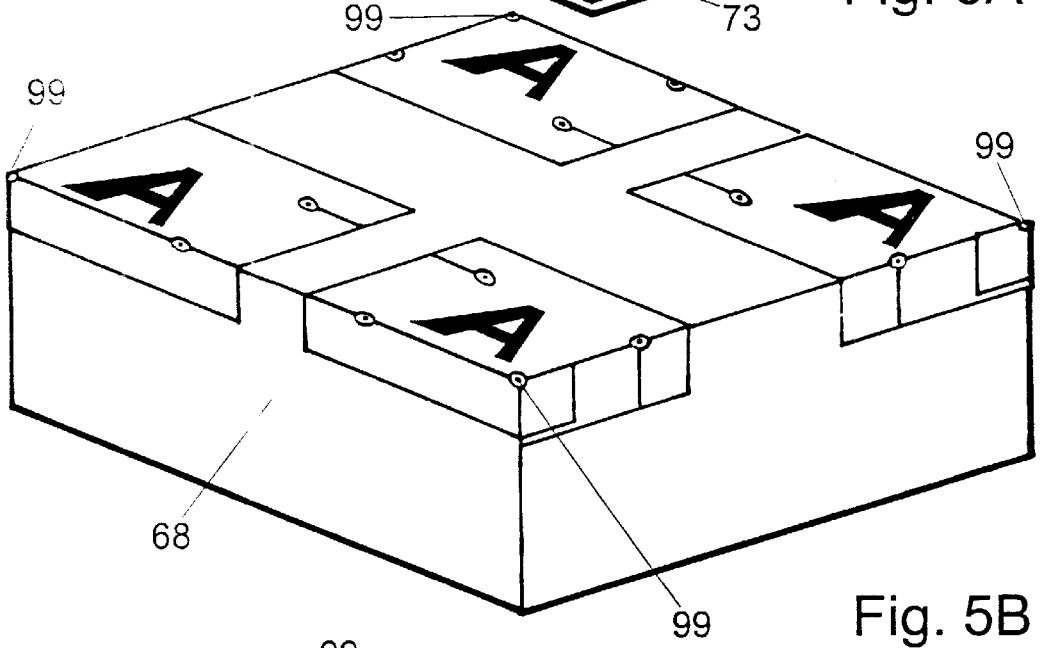
FIG. 5B is a perspective view a parcel having the label of FIG. 5A applied to the top corners of the parcel to show gyroscopic readability of the "A" character by test matching each of the corner slits of the three-dimensional label to match a similar parcel corner.
Figure 5C:
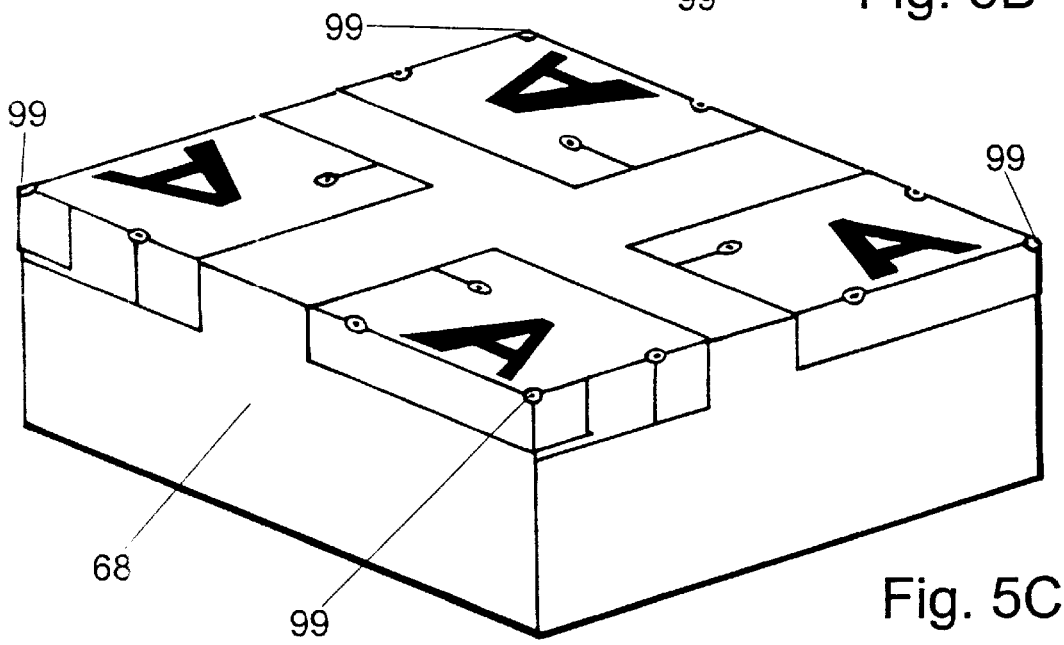
FIG. 5C is a perspective view to show readability of the "A" character application when using the same slit on the three-dimensional label shown in FIG. 5A as it is applied to the top corners of a parcel.

FIG. 5A–5C—Gyroscopic Readability

The second embodiment discussed above with reference to FIGS. 2A–2D is shown in FIGS. 5A–5C to further illustrate the flexibility of its design. FIGS. 5A–5C are perspective views of the tractor-fed imprinted three-dimensional labels of Embodiment 2 having multiple silts which permit the user to select one of multiple quadrant systems, wherein each quadrant system is defined by a selected information focal point as the center of the quadrant system and a selected viewing orientation. The multiple quadrant system permits label 33 to be applied to any corner without sacrificing a readable orientation. This flexibility of design is referred to as "gyroscopic readability."

FIG. 5A is a perspective view of two tractor-fed three-dimensional labels 33 having a top of form 50 for printing the programmed fields of information in the correct position. The figure "A" has been chosen as an indicia to simplify the illustration and orient a text item by choosing a slit 73 for a particular application as shown in FIG. 5C in this case. Each label 33 has four label centers 103 and four slits 73 each extending parallel to top of form 50 from label center 103 to the closest edge. This provides a flexible design, permitting the label to be applied in any direction to any corner of a parcel box or envelope.

FIG. 5B is a perspective view of label 33 of FIG. 5A applied to each of the top four corners of a box parcel. Each label is marked with the indicia "A" to show how the use of the four different slit placements on the three-dimensional label design can control text indicia to be "gyroscopically readable". That is to say, the text or indicia will have the same readable orientation by using a different slit on label 33, and aligning that slit with corresponding box parcel corner 99. This may be useful when it is required to apply the three-dimensional label to a different corner than anticipated, when the best corner for the label to applied cannot be anticipated when printing the label, or to just simplify the label production by making the label useful for any situation. Once the position of the label is chosen, the proper slit is aligned on chosen corner 99 of the parcel. Thus, a three-dimensional label design may be readily positioned to maintain its readability in a variety of circumstances.

FIG. 5C is a contrasting example using only one slit. Label 33 is applied to each top corner 99 of parcel 68 by repeatedly aligning the same lower southeast slit 73 on each corner 99. The readability test here shows how box parcel 68 must be rotated in order to read label 33 when the latter is inconveniently applied.

FIGS. 3A–3D—Three Dimensional Label without Slit

FIGS. 3A through 3D illustrate a third embodiment comprising a folding three-dimensional label. This embodiment is significant for the fact that it does not include a slit. Instead, one of the quadrants, in this case the one marked with "D", is folded along lines 180 and line 90 and hidden behind either billboard "A" or "C". The three-dimensional label may be trimmed as shown having a die-cut section 81 removed from the outer edges of the "D" billboard. The adhesive of the overlapping billboard segment "C" will seal the edges over the now concealed billboard segment "D". This hidden billboard segment may used to show contents or pricing information or other information on a parcel that the shipper did not want to be known to the public. Additional uses contemplated include a return authorization label or an instruction to accomplish a needed return in the original protective packing for the merchandise should that be necessary. The use of clear tape over a three-dimensional label edge between "A" and "C" billboards is preferred.

Figure 3A:
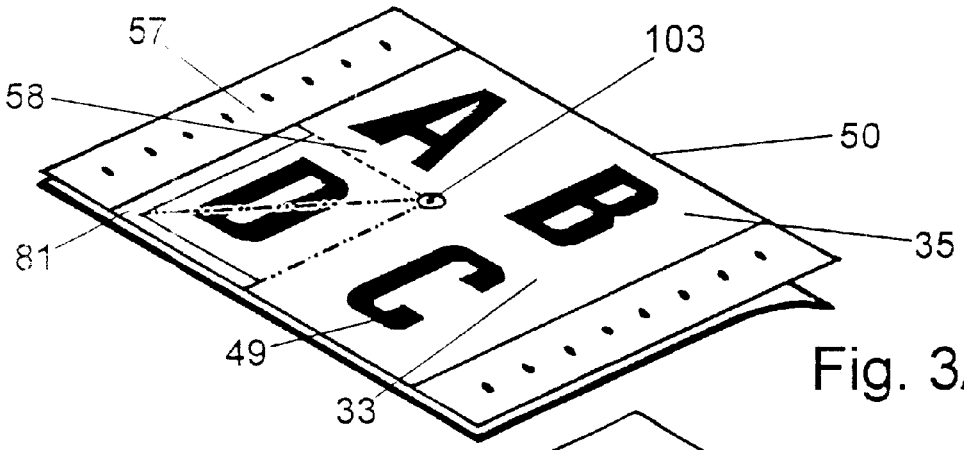
FIG. 3A shows a folding three-dimensional label having four billboards and a die cut section to be removed on billboard "D" in accordance with the invention.

FIG. 3A illustrates label 33 as laid out on continuous-feed printer paper. Die-cut section 81 of the "D" billboard is removed prior to application of label 33 to allow an overlapping billboard 38, marked with a "C", to be applied over the trimmed billboard "D" so that overlapping billboard "C" covers the shortened edges of the "D" billboard. The embodiment shown here is printed in a typical fashion using the top of form or gripper 50 to align the form of tractor-fed stock 57 in a computer printer (not shown) where impressionable substrate 58 may be marked, in this case with ink 49 from an impact printer or a dot matrix printer. The next step is aligning label center 103 of label 33 with parcel corner 111.

Figure 3B:
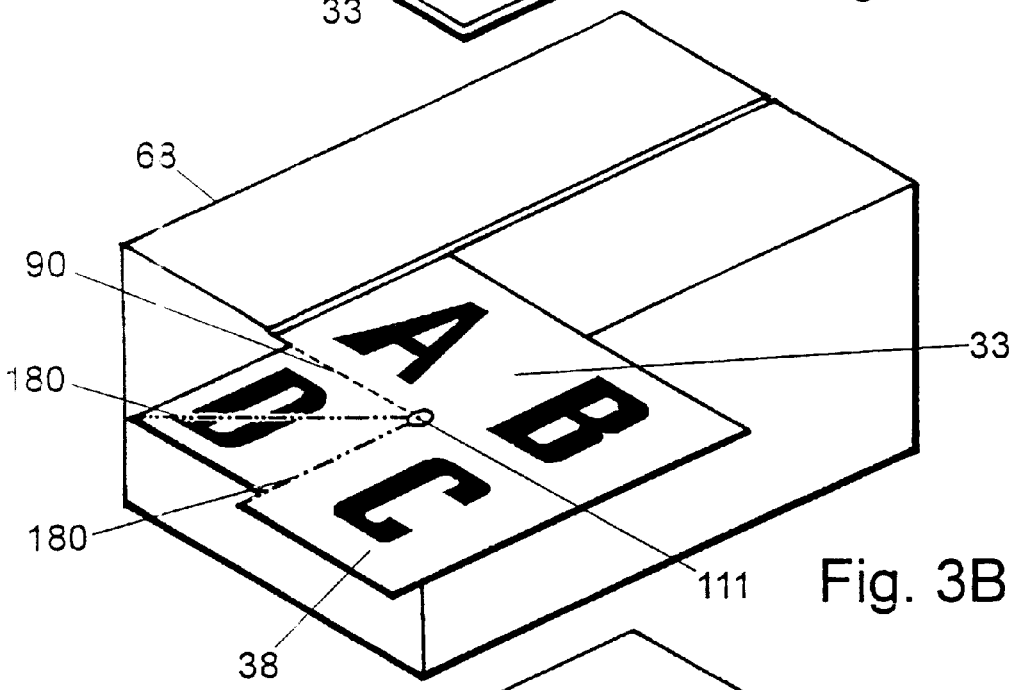
FIG. 3B shows the folding three-dimensional label of FIG. 3A initially aligned on a parcel corner.

FIG. 3B is a perspective view of the label shown in FIG. 3A and shows the three-dimensional label 33 aligned on box parcel 68 such that its center is coincident with corner 111. The three folds that are shown on the "D" billboard include a single 90° fold along line 90 shown with a dashed line and two folds of 180° shown along lines 180. Of course, the lines are shown for illustration purposes only, and need not be printed on the label. "C" billboard 38 is an overlapping billboard, although the "A" billboard can instead overlap the "D" billboard should there be any advantage to use one over the other. The shortening of the "D" billboard segment will allow the adhesive of the overlapping billboard "C" to completely cover "D".

Figure 3C:
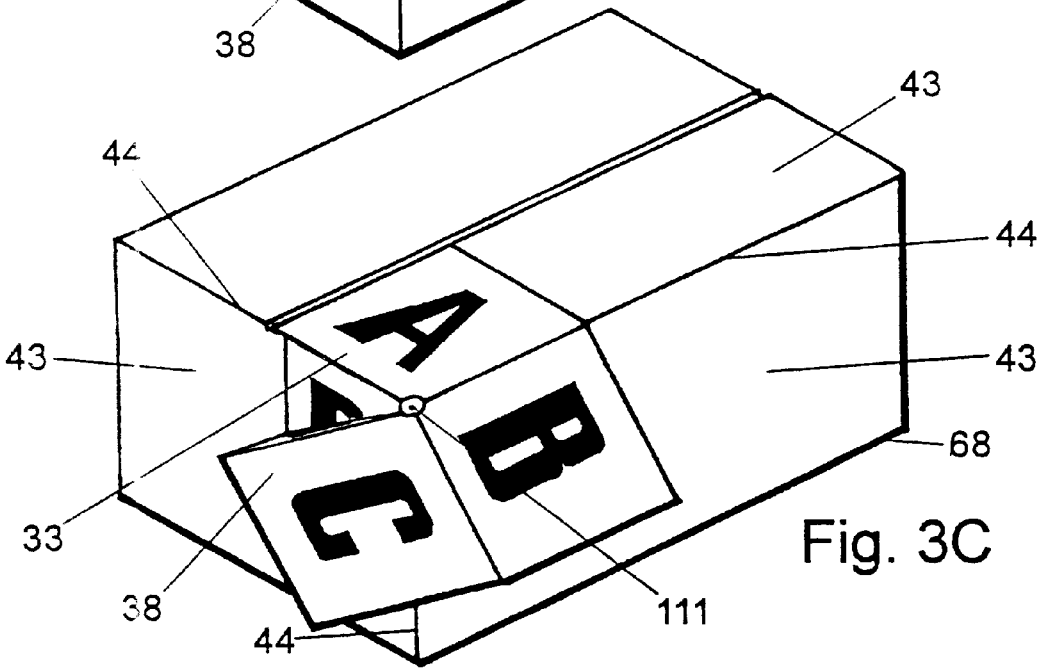
FIG. 3C shows the folding three-dimensional label of FIG. 3B during the application of the label to the parcel.

FIG. 3C is a perspective view of the three-dimensional label 33 as it is applied to box parcel 68. Preferably, the fold-lines are creased during manufacture label 33 to make application of the label easier. Overlapping billboard 38 completely covers the "D" billboard of label 33.

Figure 3D:
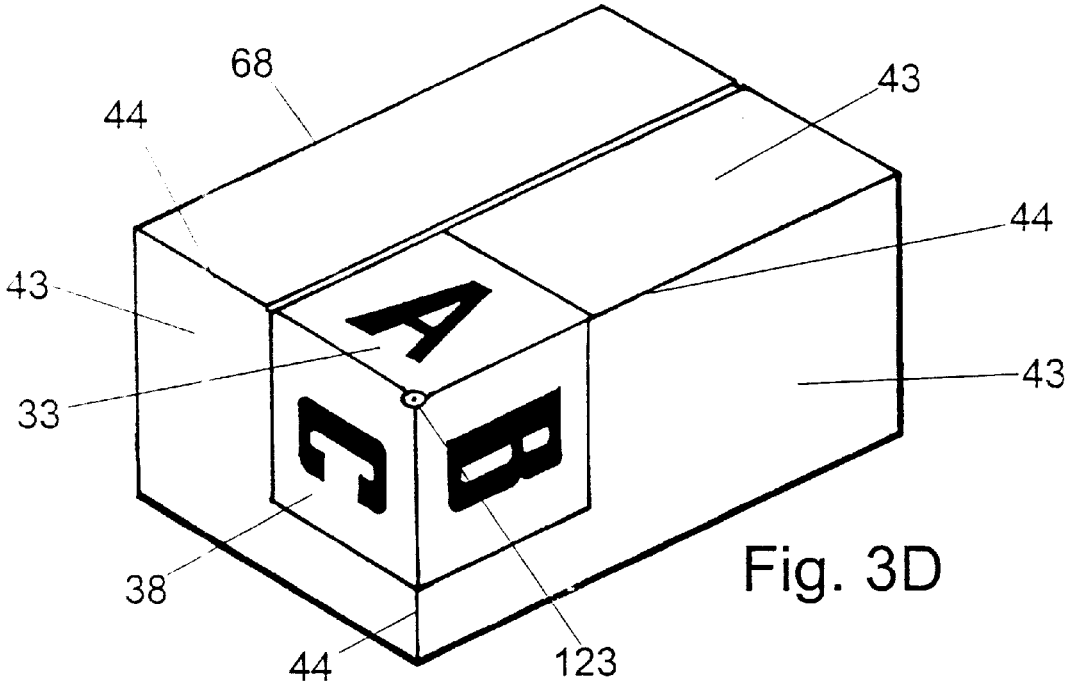
FIG. 3D shows the three-dimensional label of FIG. 3C applied to the parcel corner.

FIG. 3D is a perspective view of the label 33 of FIG. 3C after it is applied to box parcel 68. The apex formed by converging edges 44 and contiguous sides 43 is now the information focal point 123 of the parcel 68. The overlapping billboard 38 shown as "C" in this embodiment adheres over the folding billboard "D".

FIGS. 4A–4D—Method of Designing Labels and Examples

FIGS. 4A through 4D' are series of seven perspective drawings, referred to as the locus design section, to teach about the use of a locus in designing a visually balanced, three-dimensional label. In applying the use of "slit scrolling" as a mental design tool for producing three-dimensional labels the reader will have an ability to design three-dimensional labels having visually balanced billboards when applied to a parcel.

Figure 4A:
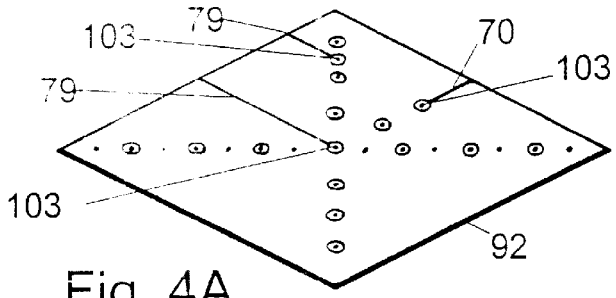
FIG. 4A is a perspective view of a three-dimensional label design template to illustrate a locus for possible positions and lengths of slits in accordance with the invention.
Figure 4B:
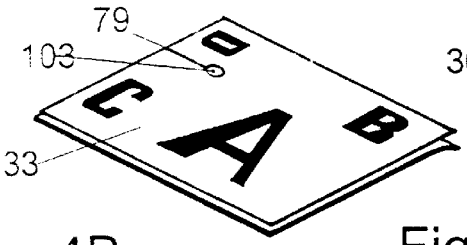
FIG. 4B is a perspective of a one information billboard design cut from a locus seen in FIG. 4A.
Figure 4B:
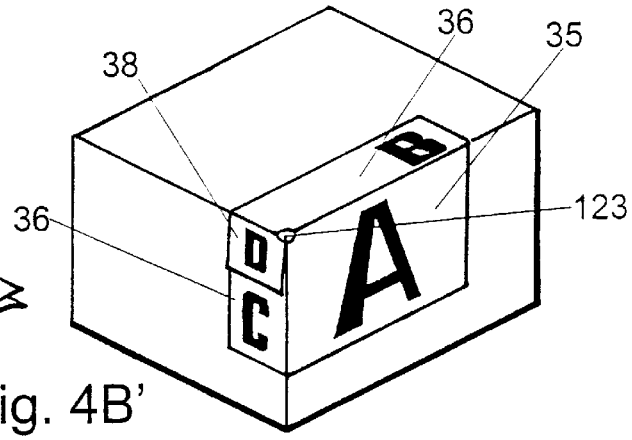
Figure 4C:
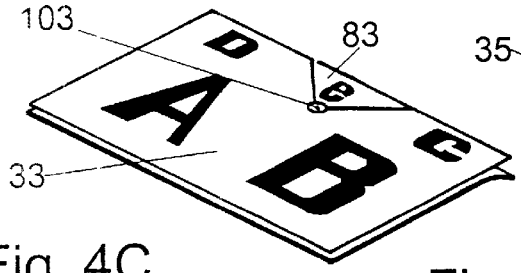
FIG. 4C is a perspective of a two information billboard design having a "V" die-cut section.
Figure 4C:
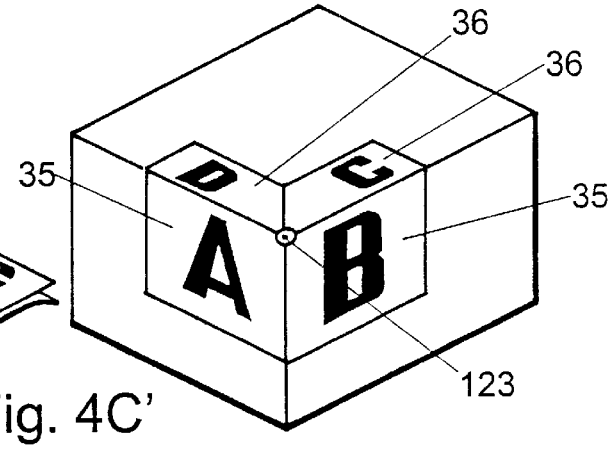
Figure 4D:
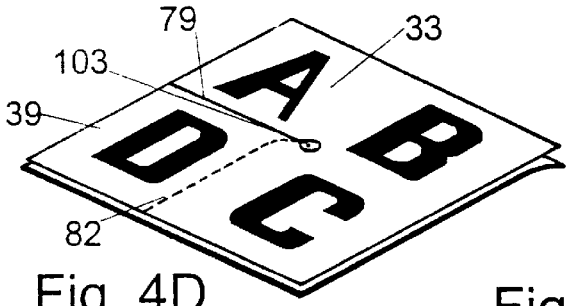
FIG. 4D is an example of a three information billboard design, using a perforated overlapping "J" cut section originating from a locus design template seen in FIG. 4A.
Figure 4D:
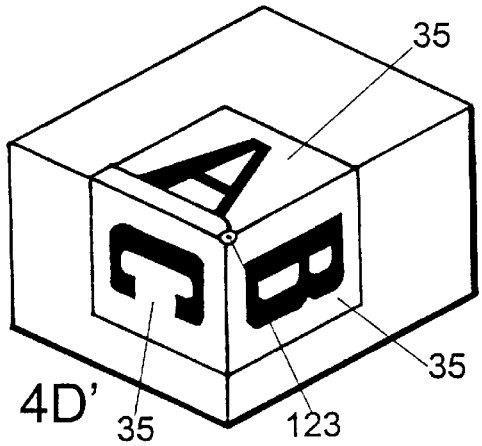

FIGS. 4B through 4D illustrate the design effect of scrolling a slit on a three-dimensional label design template. FIGS. 4B' through 4D' show the effect each three-dimensional label design will have when applied to a parcel. FIG. 4A serves to illustrate a set of endless possibilities for "slit scrolling". The slit-scrolling process is visualized by imagining a rule or "T-Square" that is made to remain perpendicular to a side, top, or bottom as it is scrolled up or down the edges of a drawing board. In the same manner, visualize the slit doing the same in order to see how a perpendicular slit may come from any of the four edges. Any slit envisioned extends from a point within the boundaries of the label to an edge and is in a direction that is perpendicular to that edge. While only one slit may be needed for an application, multiple slits on a three-dimensional label will offer versatility in a stock design or choice in how to apply a three-dimensional label for readable orientation and/or allowing its use on many various types of parcels. The three-dimensional label locus is a set of points forming a line that bisects the 90° corner of a rectangular three-dimensional label.

FIG. 4A is a perspective view of a square locus design template example 92. Template 92 shows how a slit begins at one of a locus of points that will give a predictable mathematical result of having at least two of its billboards of equal width and/or length when viewed on the parcel as shown in FIGS. 4B', 4C', and 4D'. This visually pleasing application of a three-dimensional label having balanced billboard widths is done by purposeful planning. The beginning of slit 79 or any slit away from the label's center is referred to as the information focal point 103 and is illustrated with a target symbol. Skewing the position of the information focal point 103 on the label face will produce many results. However, preferred designs result from placing the beginning of the slit, i.e., the information focal point 103, at one of points from the locus of points bisecting the label from corner to corner shown by the line of exemplary target symbols shown in template 92 in FIG. 4A.

Movement of the information focal point 103 and slit 79 varies the design of a three-dimensional label. Projecting down one may view FIGS. 4B, 4C, and 4D. This locus or imaginary line is formed of points that bisect any corner of a rectangular three-dimensional label having 90° corners. While all designs will have four billboards segments available to mark a corner, their respective sizes are controlled by a slit's scrolled position on an edge and its length.

FIG. 4B is a perspective view of three-dimensional label 33 which has a single slit 79 according to the guide lines shown in FIG. 4A. This is accomplished by scrolling a slit perpendicular to a side and adjusting its slit length to terminate at point 103 which corresponds to one of the locus of points on design template 92 discussed above with reference to FIG. 4A. This technique will always provide a design that has a minimum of two billboards of equal width and/or length when applied to a parcel.

FIG. 4B' is a perspective view of the three-dimensional label shown in FIG. 4B and which is also featured previously in FIGS 1A–1C. The purpose of showing it again is to illustrate how a three-dimensional label we are familiar with relates to three-dimensional label design template 92 shown in FIG. 4A. Printed billboard segment 35 and marker billboard segments 36 and overlapping billboard 38 as applied on a parcel corner mark it as information focal point 123.

FIG. 4C is a perspective view of three-dimensional label 33 having two information billboards and two marker billboards. The design is projected down from the top layout of FIG. 4A and includes a V-shaped die-cut section 83 marked as "e" in place of a slit 70. The V-shaped die-cut has its vertex at information focal point 103, which is displaced toward the edge of the label from the center of locus discussed above with reference to FIG. 4A. By reducing the length of a V-shaped die-cut section 83 to be short of the center of a locus there will be two billboards having an equal width and/or length. Using a V-shaped cut section 83 eliminates the overlap of marker flaps 36 when label 33 is applied to a box parcel. By providing a shortened slit or V-shaped section, the largest possible information billboard segments 35 are created.

FIG. 4C' is a perspective view showing the label of FIG. 4C applied to a box parcel. There is no overlap of marker billboard segments 36 on the top of the parcel because of V-shaped die-cut section 83. Information focal point of the parcel 123 is marked by a target symbol and the use of two information billboard segments 35 are visibly positioned on two contiguous side panels of the parcel.

FIG. 4D is a perspective view of a three-dimensional label 33 showing an application of a four billboard design having a single slit 79 and a removable billboard 39 which can used for any number of accounting possibilities. Perforated J-cut 88 allows easy removal of the "D" billboard. The slit and perforation extend to the information focal point 103 of label 33 and is indicated by a target symbol. This is all accomplished by using locus three-dimensional label design template 92 of FIG. 4A.

FIG. 4D' shows a perspective view of label 33 of FIG. 4D applied to a box parcel. Three printed billboard 35 segments are wrapped and folded about an information focal point 123 of the parcel.

Figure 6A:
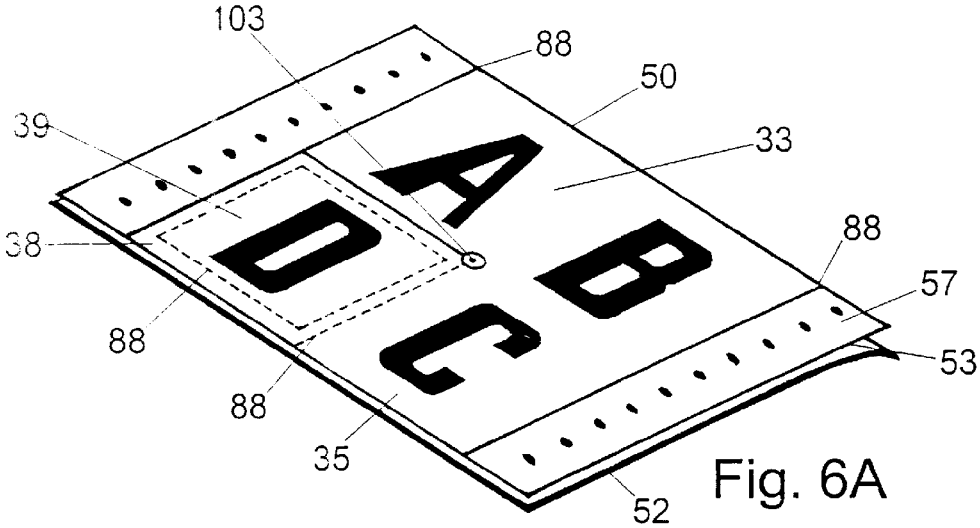
FIG. 6A is a perspective view of a tractor-fed three-dimensional label having a removable or overlapping billboard segment in accordance with the invention.
Figure 6B:
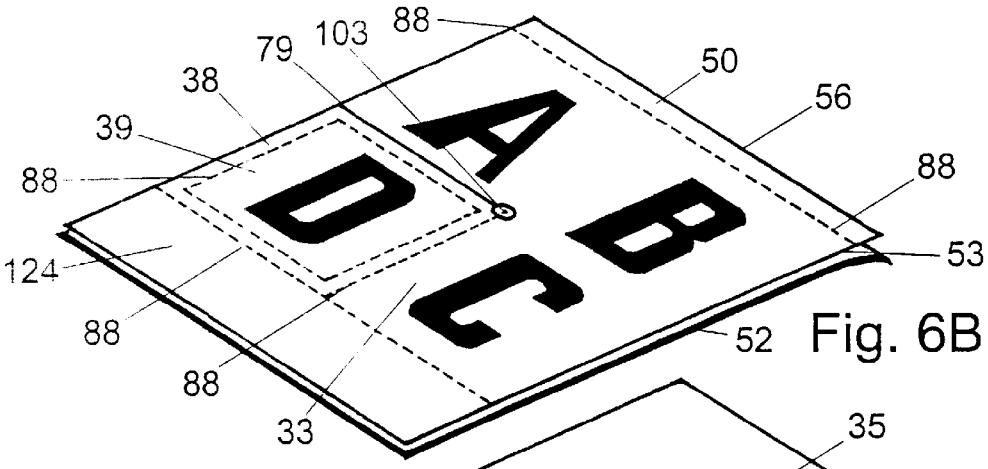
FIG. 6B is a perspective view of a label similar to that shown in FIG. 6A except that it is printed using a sheet-fed printer.
Figure 6C:
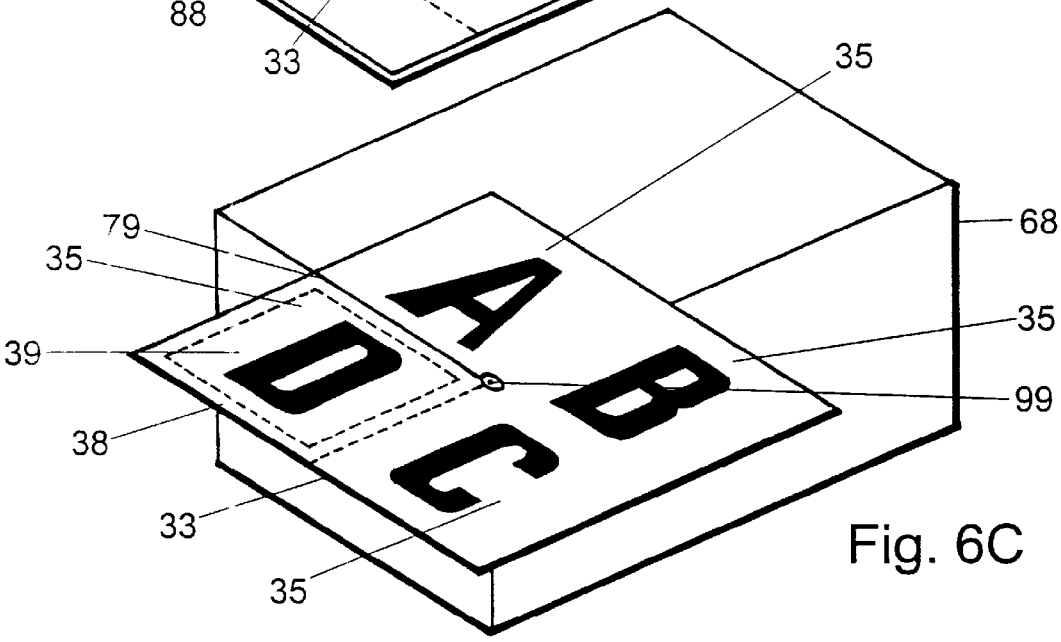
FIG. 6C is a perspective view showing the three-dimensional label from FIGS. 6A or 6B having its information focal point aligned on a parcel corner.

FIGS. 6A–6C—Removable Portion to Expose Underlying Billboard

FIG. 6A–6C illustrate a fourth embodiment in accordance with the invention. Both a continuous tractor-fed three-dimensional label 33 and a sheet-fed three-dimensional label 33 having a single slit 79 and several perforations 88 in the face of the label 33 are shown in FIGS. 6A and 6B. Overlapping billboard 38 is designed to be removable, and may be removed after label 33 is applied, such as during the parcel lifecycle. This variation would allow the use of label 33 to be used as a collect on delivery (C.O.D.) label or for deliveries requiring verification of delivery.

FIG. 6A is an example of a continuous form tractor-fed three dimension parcel label or three-dimensional label 33 having full use of four information billboard segments 35 shown, for purposes of illustration, with the indicia "A", "B", "C", and "D". The perforations 88 allows removable billboard segment 39 to be removed from inside of a overlapping billboard 38. By not applying adhesive to the back side of removable billboard segment 39, removable billboard segment 39 is easily removed by tearing along perforations 88. In other words, the inner perforated segment 39 is clear of adhesives and can be removed to expose segment "A", which may be a return address or other useful information in actual practice. Overlapping billboard 38 marked "D" may be utilized as a C.O.D. billboard or it may be removed to provide additional information selected or programmed to be printed on the "D" label. Alignment of the form in a printer (not shown) is concerned with positioning the top of the form 50 in the initial stage of printing a three-dimensional label. Application of label 33 onto a parcel is completed by removing release backing 53 and exposing adhesive 52 prior to aligning and smoothing the label around a selected corner of the parcel as discussed with reference to FIG. 6C below.

FIG. 6B shows a label 33 identical to that of FIG. 6A, except its is formed in a sheet which can be printed using a sheet-fed printer (not shown) or typewriter (also not shown) instead of a tractor-fed printer. The three-dimensional label 33 is applied by removing the top and bottom blank portions by tearing along top and bottom perforation lines 88 and releasing backing 53 in order to expose pressure sensitive adhesive 52 prior to final positioning or aligning it on a chosen corner of a parcel as discussed with reference to FIG. 6C below. Although shown here only with reference to this embodiment, it should be clear that the invention does not limit means by which a label may be printed, and in fact any label produced using a tractor feed printer can also be produced using a sheet-fed printer by simply modifying the design to conform with the requirements of a sheet-fed printer, i.e., separate sheets of appropriate size instead of continuous-form stock with tractor guides on the left and right sides. Other configurations for printing purposes may also occur to those of skill in the art.

FIG. 6C shows label 33 of FIGS. 6A and 6B with single slit 79 aligned to corner 99 of box parcel 68. The overlapping billboard segment 38 and removable portion 39 of billboard segment 38 are positioned to fold and wrap around aligned information focal point 99 and then overlap billboard segment "A".

Figure 6D:
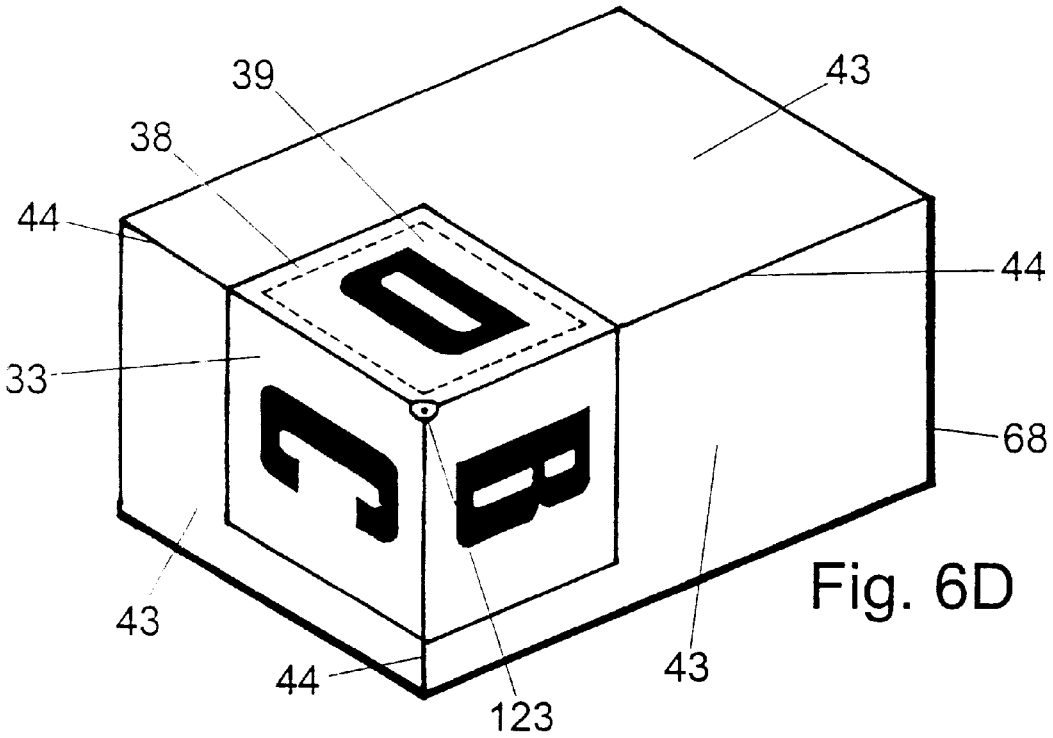
FIG. 6D is a perspective view showing the three-dimensional label from FIG. 6C having an overlapping or removable "D" billboard segment applied to the parcel corner.

FIG. 6D shows label 33 of FIG. 6C applied to a chosen corner which is now information focal point 123 of parcel 68. For this embodiment, application is made in a clockwise direction of A, B, C, and D. The fourth billboard or what may be an inner removable C.O.D. billboard segment simply shown as "D" having a perforated removable overlapping panel segment 39 to hide the first or "A" billboard segment which may contain a hidden return address label or an authorization having an instruction to call for a return authorization number to be written on the three-dimensional label face.

Tear-off perforation line 88 extending from information focal point 103 is optional. A removable design feature such as a cut-out (not shown) or an extending tab (not shown) may be provided to allow easy removal of removable segment 39 by a delivery driver or other individual. Removal of billboard segment 39 exposes billboard "A". While there are many potential uses of this feature, one such use is to use it as an authorized return label with a requirement to call for a return authorization number to be written on a three-dimensional label face or billboard segment such as "A". For a mail-order company that is confident of the quality of their products and methods of doing business this may be an excellent vehicle to stimulate customer confidence and increase sales. Additionally, this technique could encourage customers to return the merchandise in the original packaging when a return is necessary since the packaging is provided with a return label, thereby affording better protection of the merchandise on its return trip.

FIGS. 7 and 8A–8C—Imprinted Labels

Figure 7:
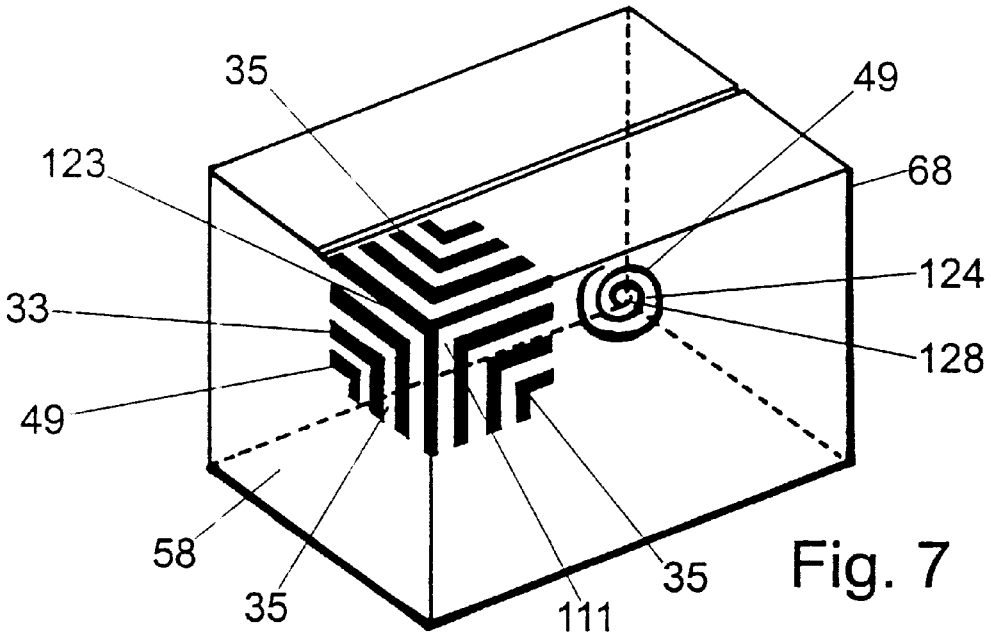
FIG. 7 is a perspective view of a three-dimensional label printed in ink directly on a box parcel showing the information focal point and additionally marking the hidden corner as a spiral graphic on the parcel in accordance with the invention.

FIG. 7 is a perspective view showing a fifth embodiment comprising box parcel 68 in which hidden corner 128 as well as an information focal point corner 123 are displayed at the same time using hidden lines to see through the box parcel. These markings are accomplished by having an imprinted three-dimensional Label 33 applied in ink 49 directly to a chosen corner during the manufacturing of parcel box 68. A printed hidden corner marker 124 may be directly imprinted in ink 49 to the substrate of a flat box parcel. The hidden corner 128 is located diagonally opposite label 33 through the center of parcel 68. The printed three-dimensional label 33 marking in ink directly on substrate 58 or laminate applied onto substrate 58 will fold to make the orientation of a parcel instantly understood. Finding the location for information about a parcel's contents and direction may be quickly found and/or posted on a visual information center 111 as a collective term for the corner marking. The marker billboard 36 segments may be separately printed with indicia or text information as required or traditional two dimensional labels may be applied onto the contiguous sides at an information focal point 123.

Figure 8A:
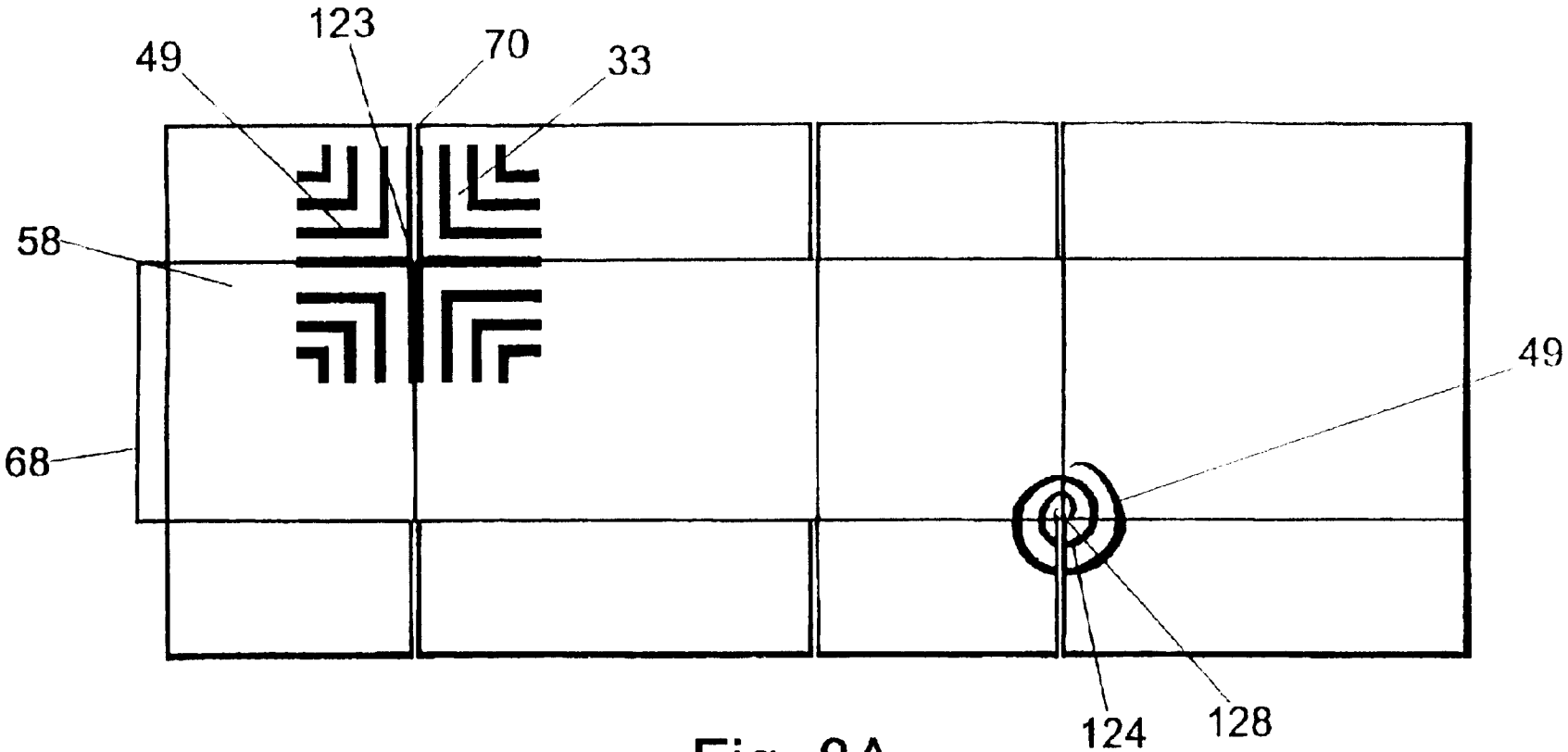
FIG. 8A is a plan view of the box parcel layout showing the three-dimensional label directly printed with ink on the parcel substrate.
Figure 8B:
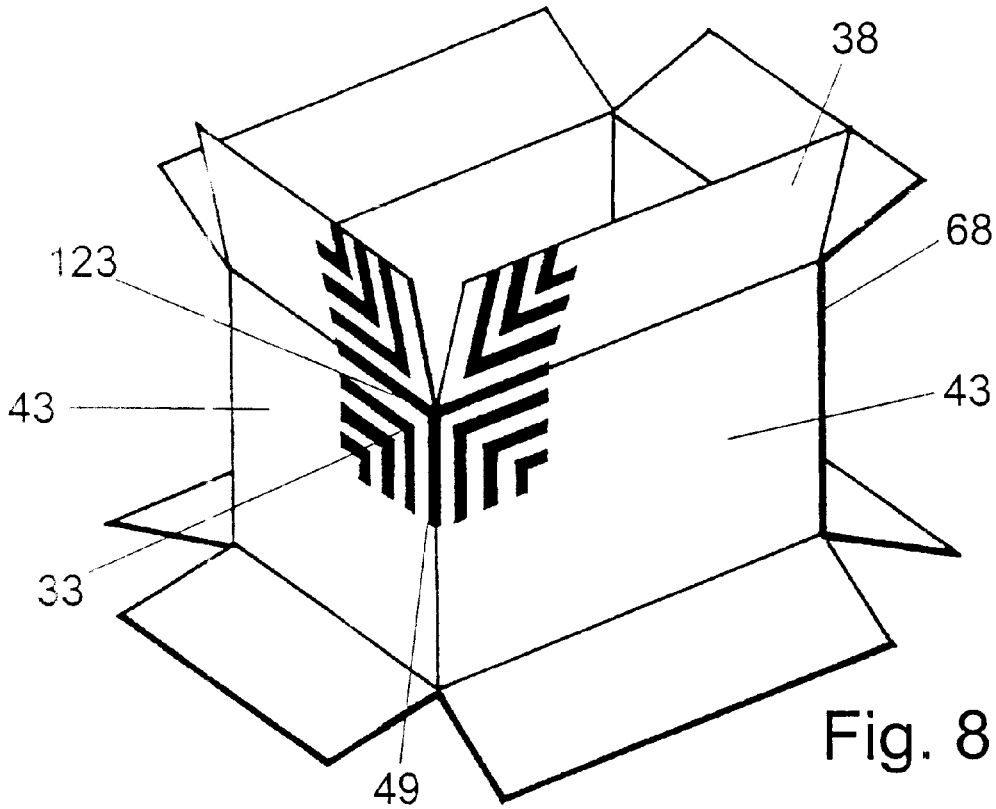
FIG. 8B is a perspective view of the three-dimensional label shown in FIG. 8A when initially folded to become a box parcel.
Figure 8C:
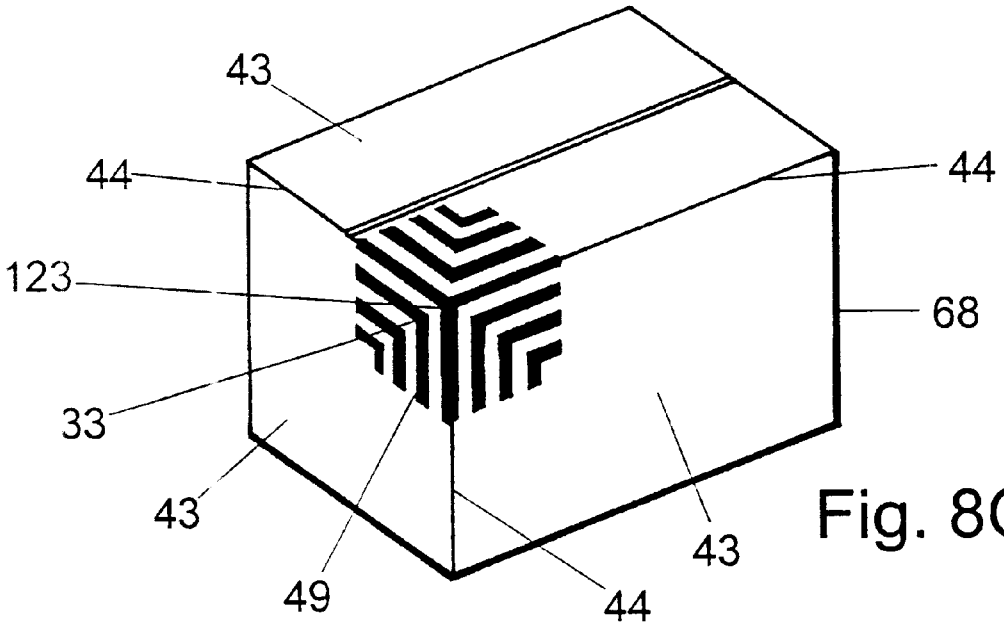
FIG. 8C is a perspective view of the three-dimensional label shown in FIG. 8B when assembled.

FIGS. 8A through 8C illustrate an example construction of label 33 imprinted in ink 49 applied to a impressionable substrate 58 of a box parcel 68 from FIG. 7. Substrate 58 may be corrugated cardboard, extruded plastic, or carton board and printed during its manufacture while in the flat stage of production.

FIG. 8A illustrates a plan view of the three-dimensional label 33 directly applied by means of imprinting with ink 49 onto an impressionable substrate 58 of a box parcel 68 prior to assembly of box parcel 68. Hidden corner 128 is shown with marker 124 which is a spiral graphic also printed in ink 49 in this embodiment. Impressionable substrate 58 may be corrugated cardboard, corrugated plastic, or carton board and it may be marked by any known method including silk screen, flexography, letterpress, inkjet, applied lithograph cover sheet in a lamination top sheet applied to the entire surface of the parcel substrate. The slit 70 becomes the operating device which opens to fold the three-dimensional label 33 that has been directly imprinted or applied as a laminate onto box parcel 68.

FIG. 8B shows label 33 of FIG. 8A while being folded into its final useable state to be used as a container for shipping goods. This illustrates how label 33 functions with the overlapping flap 38 shown prior to the completed assembly of parcel 68. The imprinting of label 33 directly on a shipping substrate's contiguous side panels 43 and overlapping billboards 38 will effectively locate information focal point 123 on parcel 68.

FIG. 8C is a perspective drawing of label 33 of FIGS. 8A and 8B and shows an assembled marked parcel 68 that has been directly imprinted with ink 49 to form a visual information center to post information about its direction and contents composed of the converging edges 44 and the contiguous sides 43 of the parcel, drawing attention to information focal point 123 of parcel 68.

Figure 9A:
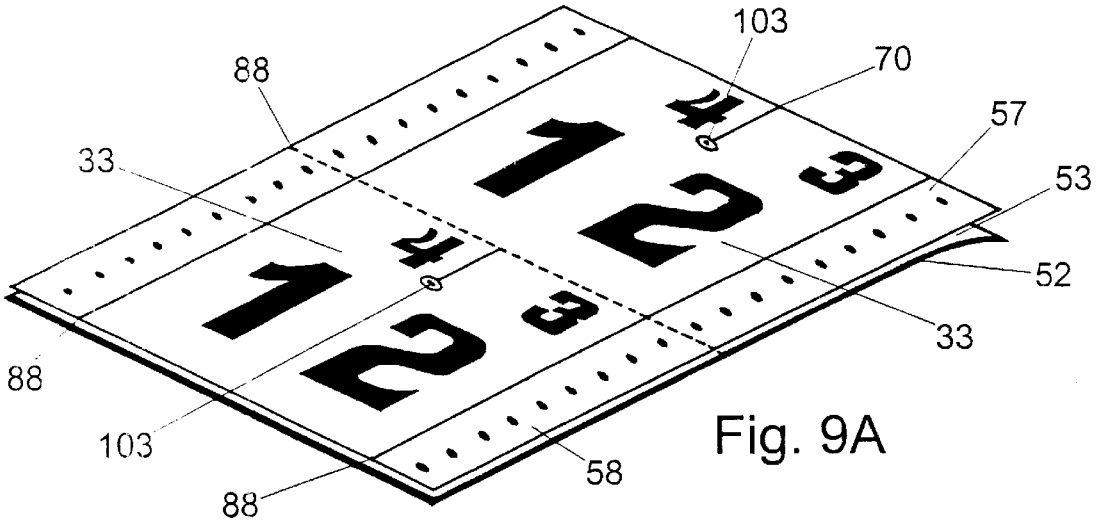
FIG. 9A is a perspective view of a two-billboard three-dimensional label printout having a single slit at the top in accordance with the invention.
Figure 9B:
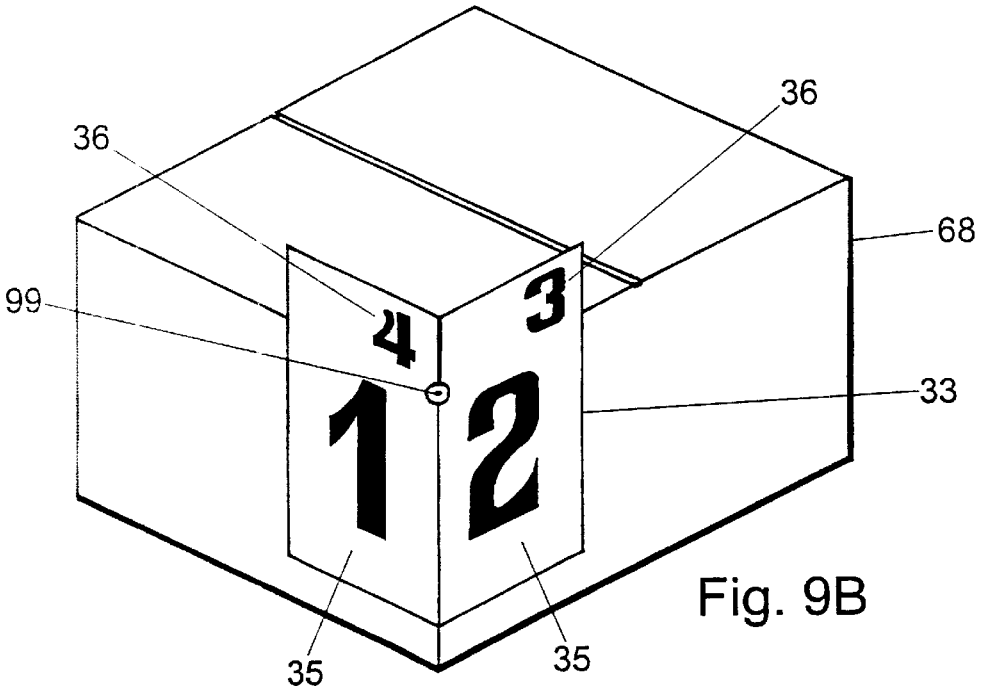
FIG. 9B is a perspective view of one of the labels shown in FIG. 9A aligned on a parcel.
Figure 9C:
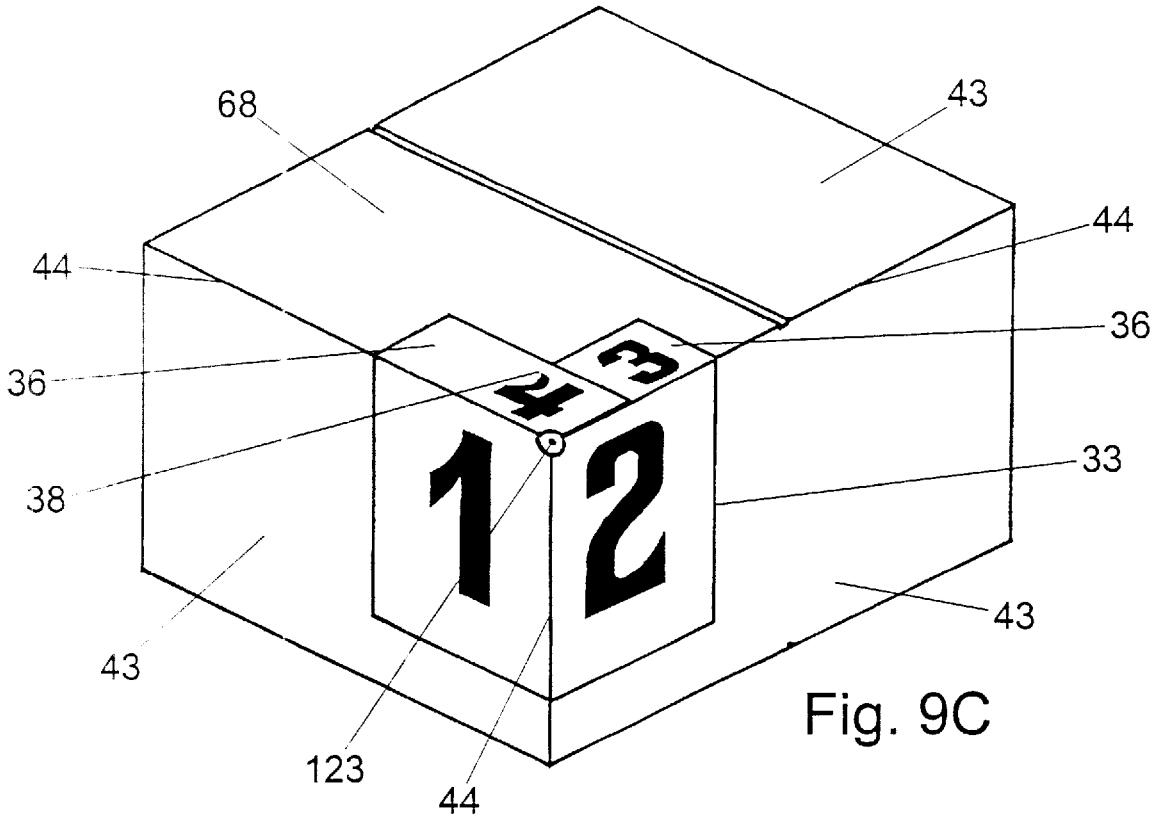
FIG. 9C is a perspective view of the label shown in FIG. 9B applied to the parcel, with two marker billboard segments showing an overlap.

FIGS. 9A–9C—Two Information Billboards

FIGS. 9A–9C illustrate a sixth embodiment comprising an overlapping marker billboard design having two information billboard segments. Two marker billboard segments 36 are applied to the top of parcel 68. The two information billboard segments 35 have indicia "1" and "2" thereon for purposes of illustration, and are much larger in proportion to marker billboards 36 by using a short slit 70. The design could be modified by skewing or moving information focal point 103 of a label 33, for example to the right or left or up or down in a perpendicular manner as if it were a Cartesian coordinate moving on an "X" or "Y" axis positioned on information focal point 103. Perforated lines 88 on label 33 allow for a quick break out from the computer tractor grippers 57 and other forms on the continuous web of three-dimensional labels.

FIG. 9A shows a potential stock design of the tractor-fed three-dimensional label 33 having a capability of being separated from a web of continuous printed labels by means of perforations 88. The information focal point 103 of labels 33 are represented by a target symbol. The impressionable substrate 58 is designed for a tractor feed impact printer (not shown), although other means may be employed to mark the substrate with required information. The slit 70 is shown in the North, or twelve o'clock position.

FIG. 9B shows a three-dimensional label 33 from FIG. 9A partially applied to box parcel 68 with label center 103 (represented with the target symbol in this figure) aligned with box parcel corner 99. Label 33 is applied by first applying information billboards 35 to two contiguous sides of box 68, then marker billboards 36 are folded onto the top contiguous side panel of the box parcel 68 which may be applied in an overlapping motion: First "3" is folded down, then "4".

FIG. 9C shows the label of FIG. 9B completely applied to parcel 68. Label 33 marks the top of the parcel with two marker flaps. Overlapping corner marker billboard 38, which is illustrated with the indicia "4" is folded over the marker billboard 36 having the indicia "3".

An advantage of the present invention is that with a single label, three contiguous sides 43 and three converging edges 44 forming an apex at a corner are marked, providing information focal point 123 which is visible from three sides of a box parcel. The three-dimensional label 33 may be wrapped and applied over as many as three contiguous sides 43 and three converging edges 44 of a chosen box parcel and/or two sides and two edges of an envelope parcel.

FIGS. 10A–10D—Transparent Envelope Label

Figure 10A:
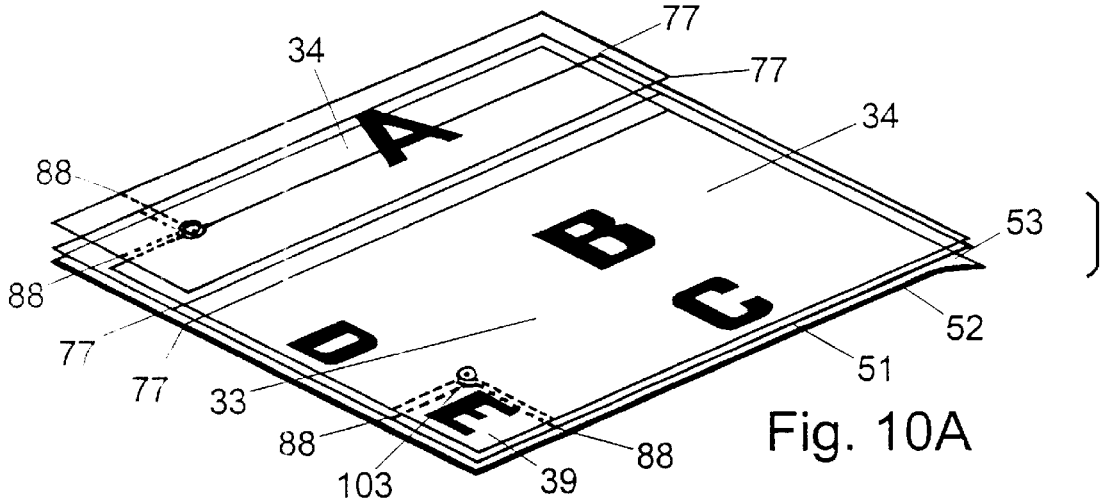
FIG. 10A is an exploded perspective view of the clear three-dimensional label document envelope with a color urgency marking layer in accordance with the invention.
Figure 10B:
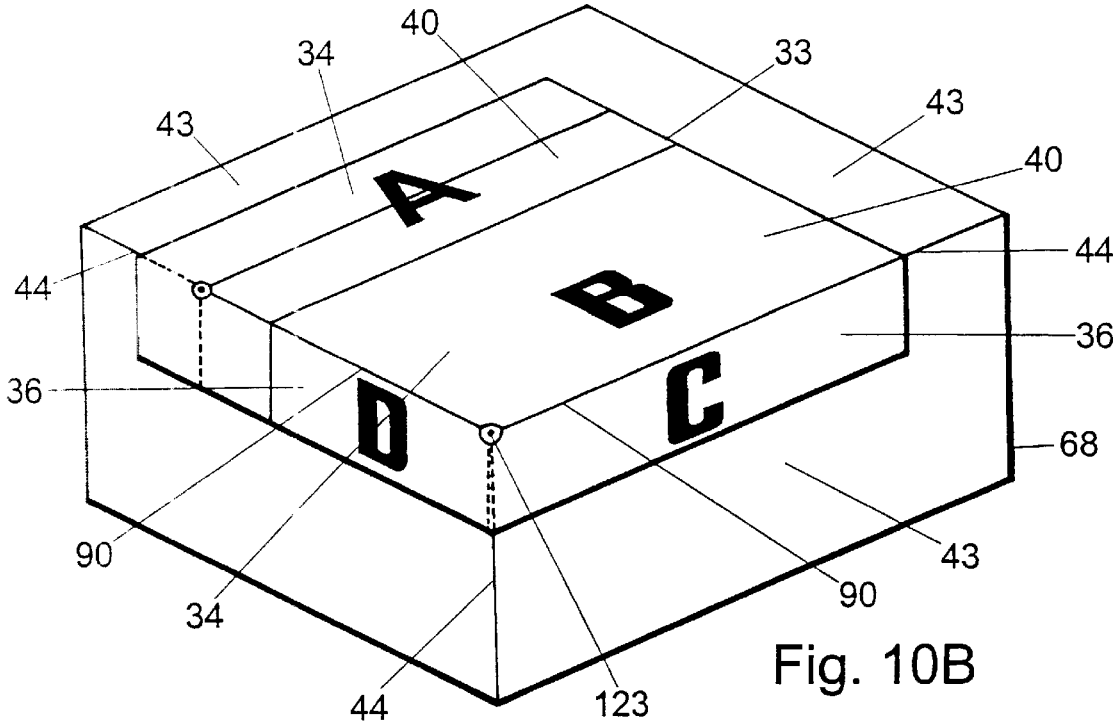
FIG. 10B shows the label of FIG. 10A applied to a box parcel corner.
Figure 10C:
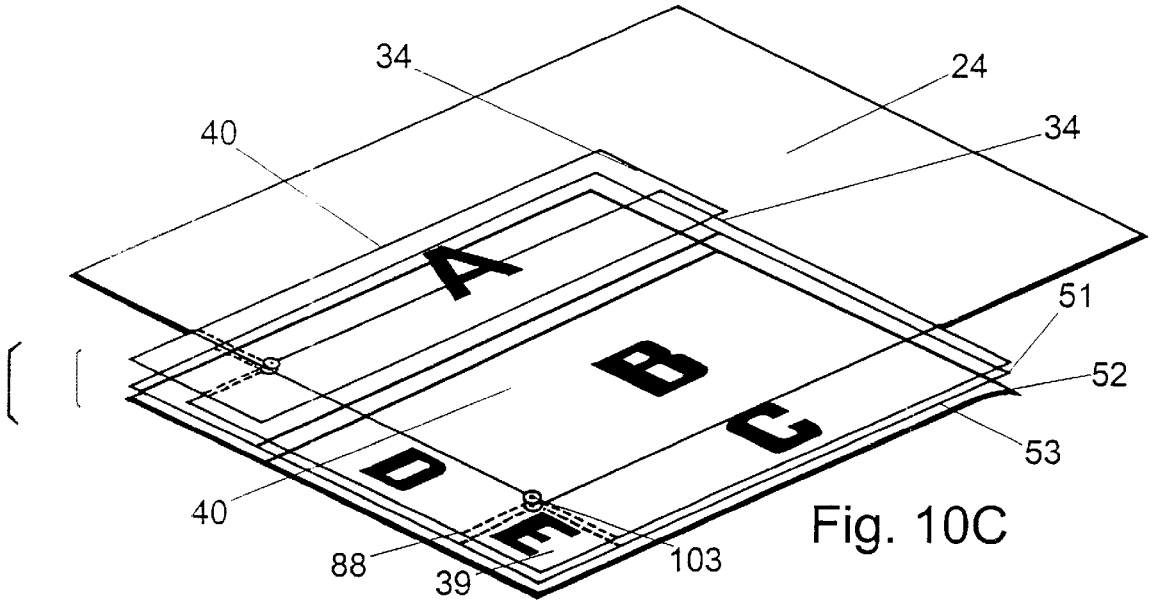
FIG. 10C shows the label of FIG. 10A aligned on an envelope corner.
Figure 10D:
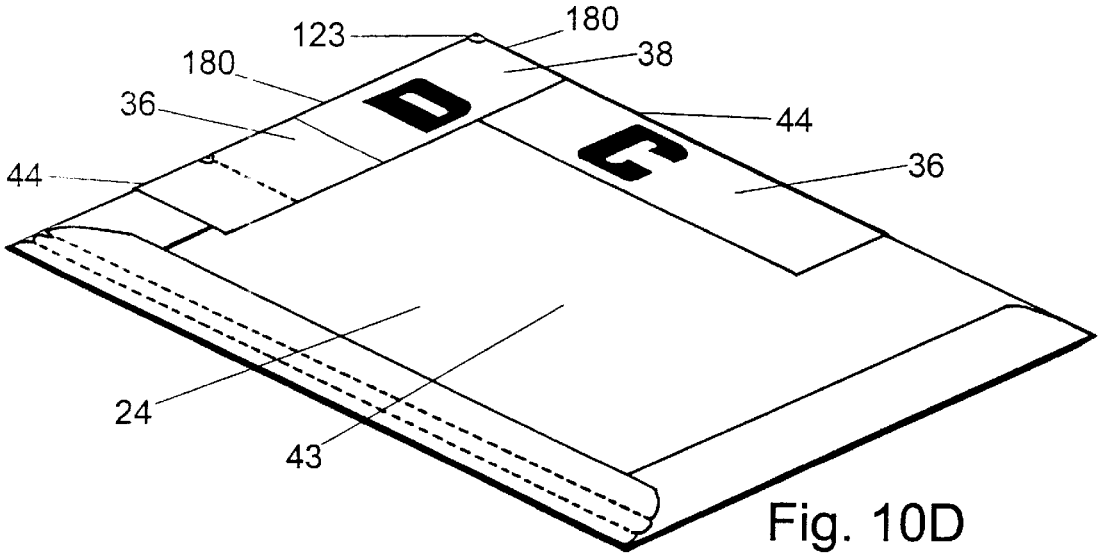
FIG. 10D is a perspective view showing the bottom of the envelope of FIG. 10C with the label of FIG. 10C applied with the marker billboards wrapped about the edges of envelope.

FIG. 10A–10D show how a use, construct, and apply a seventh embodiment comprising a three-dimensional label 33 having a transparent pockets 40 sealed along the outer edges of label 33. Three-dimensional label 33 is in itself a document envelope designed to be attached to the parcel box or envelope. In this embodiment, it is important to show how both a box parcel and an envelope parcel each show marker billboards segments 36 which are shown with indicia "D and "C", respectively, for purposes of illustration. In particular, marker billboards 36 fold over the converging edges as 90° folds along lines 90 on a box parcel as in FIG. 10B. The same label 33 applied to the document envelope parcel is shown in FIG. 10D and folds its marker billboards 36 180° along lines 180. In both cases label 33 uses a minimum of three of its billboard segments to mark a parcel corner. The overlapping fourth billboard has many constructive uses in designing a three-dimensional label for a parcel box and/or envelope.

FIG. 10A shows a perspective exploded view of the clear three-dimensional label envelope 33 having two clear overlapping billboard segments 34 that may be printed. The substrate may be translucent or opaque having a colored urgency marking 51 with an adhesive 52 applied to its backside, and a removable release backing 53. Perforations 88 may be included to allow for removal of the overlapping corner flap 39 when label 33 is applied to a parcel. When information focal point 103 of label 33 is aligned with a parcel corner and attached, marker billboards 36 easily fold about the edges of a parcel to mark the contiguous sides and converging edges of a document envelope or box parcel while safely containing the information inserted through the slit 77 on the removable backing 52 and the color urgency marking substrate layer 51. Access may me made of the information contained in the clear three-dimensional label 33 by reading through the clear overlapping billboards 34 or opening the clear overlapping access flaps of transparent sheets 40 as shown in FIG. 10B.

FIG. 10B shows label 33 of FIG. 10A applied to a box parcel 68 having contiguous sides 43 and converging edges 44 that form an apex noted as information focal point 123 on a chosen corner of a parcel. Marker billboard segments 36 shown with "D" and "C" indicia for illustration purposes wrap and fold 90° over the converging edges 44 along lines 90 and allow the observer to identify the visual information center instantly. Clear overlapping access flaps 40 are alternatively shown as clear overlapping billboards segments 34 in FIG. 10A.

FIG. 10C shows label 33 of FIG. 10A aligned to a document envelope 24. The use of perforations 88 permit removal of billboard 39 which provides a cleaner appearance. The top panels are read-through transparent sheets 40 and are welded to substrate 51 along the outer perimeter of label 33 forming two opposed pockets with overlapping flaps between them. The interior of the pockets are accessible should there be a need to remove the shipping document through the overlapping flaps of transparent sheets 40. Transparent sheets 40 may be marked with imprinted indicia, text, or trademark graphics per the needs of the customer. Label 33 is applied as most other adhesive labels by removing release backing 53 to expose the pressure sensitive adhesive 52 and applying the three-dimensional label 33 to a parcel or article. Label 33 in accordance with this embodiment may alternatively be constructed so that the color urgency marking substrate 51 as well as the release backing 53 are slit to allow for the easy insertion of a shipping document prior to the application of label 33 onto envelope parcel 24.

FIG. 10D shows the bottom view of parcel 24 of FIG. 10C after label 33 is completely installed. In particular, FIG. 10D demonstrates how the marker billboard segments 36 wrap around converging edges 44 and bottom contiguous side 43 of envelope parcel 24. Two marker billboard segments 36 are also overlapping billboards 38 in folding around the parcel edges at the corner of said parcel envelope 24 forming information focal point 123.

Figure 11:
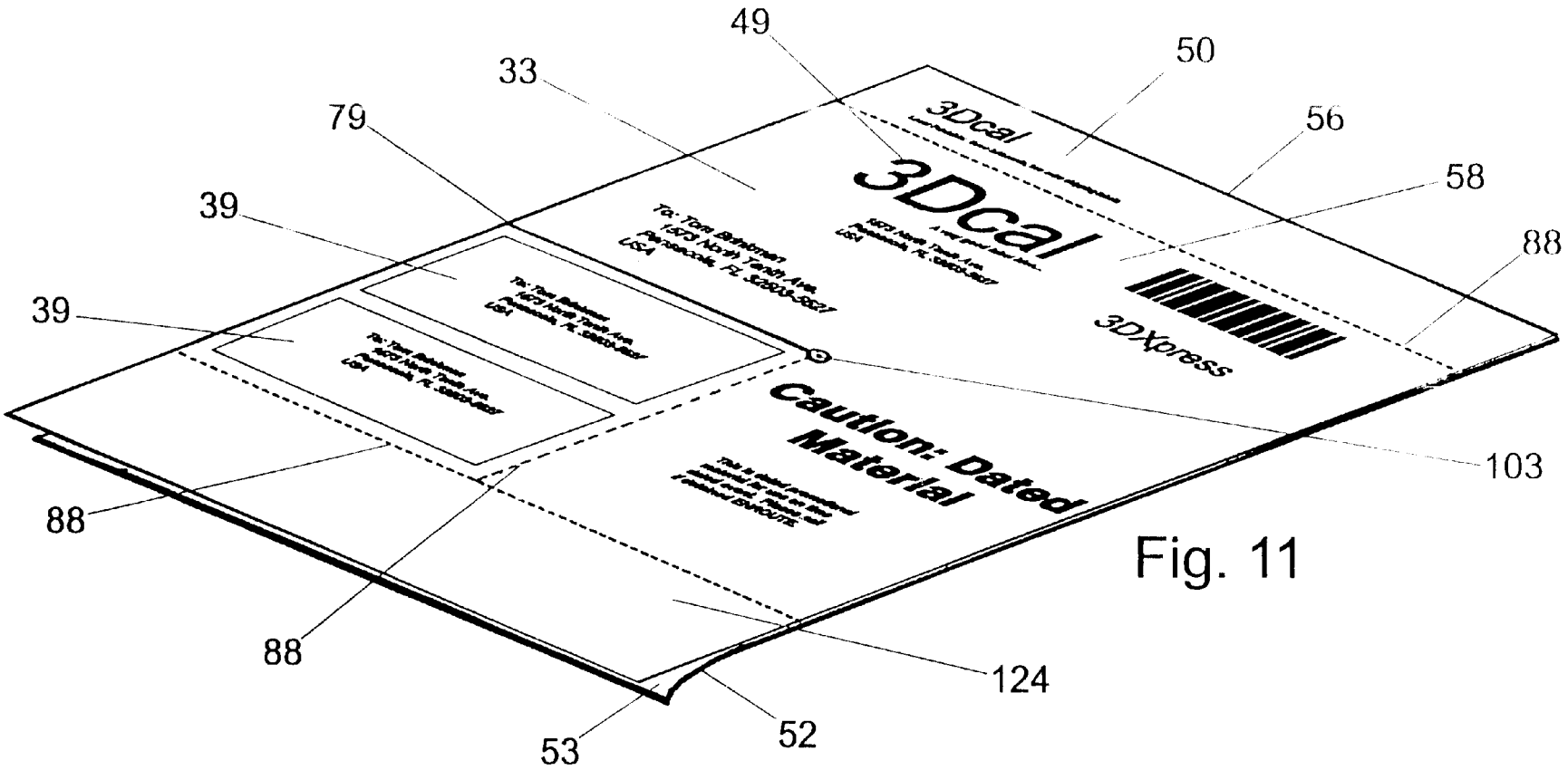
FIG. 11 is a perspective view of a sheet-fed three-dimensional label having printed fields of information in accordance with the invention.

FIG. 11—Supplemental Labels Printed with Three Dimensional Label

FIG. 11 shows an example of an eighth embodiment comprising a sheet-fed three-dimensional label 33 wherein the application of programmed fields of information appears on said label when printed with laser toner or inkjet ink 49. Substrate 58 is printed with sample information provided in fields of information located in discrete billboards providing a three-dimensional label for marking a chosen corner of a parcel. Top-of-form or gripper 50 is torn away along a perforated line 88. This illustration cross references with FIG. 6B and zooms in on another potential use of removable fourth billboard shown now as having two address labels 39. Starting with the information focal point 103 as center of a three-dimensional label design, billboard "A" in the upper left sector of the label is in this example a layout of a company logo with space for printing programmed fields of information such as a destination address. The next billboard or segment "B" shown moving in a clockwise direction provides parcel tracking information in bar-code form. The third billboard "C" here provides information about a parcel's contents such as an urgency. Information on this billboard could be encrypted with bar-codes or simply used to explained storage conditions for the contents. The fourth billboard shows a surface slit 79 and die-cuts making two additional removable labels 39 available for business needs. The application is typical in that you remove the release backing 53 in order to expose the adhesive 52 which is now aligned and applied directly onto the chosen corner of a parcel. The bottom strip may be applied to the hidden corner 128 as a hidden corner marker 124 such as is shown in FIG. 12D.

FIGS. 12A–12D—Triangular Label

FIGS. 12A–12D are a series of perspective views of a ninth embodiment according to the invention comprising a triangular three-dimensional parcel label 33 shown in an aligned animated series of four views. Viewing from top to bottom the drawings have an animated effect of how label 33 would appear before and after it has been applied to box parcel 68. This triangular version of label 33 application is provided by starting with a portion of impressionable substrate 58 which is square in shape with equal sides and ninety degree corners (but shown in FIG. 12A in a perspective view). One corner is bisected with a 45° slit 77 extending from a locus center at information focal point 103 to the tip of the corner. The slit 77 is applied on top of a locus of points that begin in the center of a three-dimensional label as shown in reference diagram of FIG. 4A.

Figure 12A:
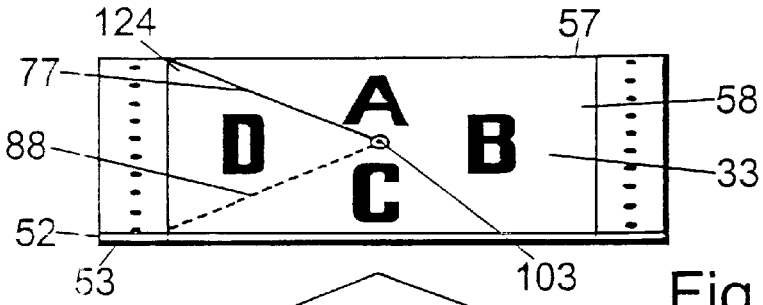
FIG. 12A is a perspective view of a square tractor-fed three-dimensional label having a slit from the center to a corner in order to form a triangular three-dimensional label when applied in accordance with the invention.

FIG. 12A This perspective view of a triangular three-dimensional label 33 after being printed using a tractor feed printer (not shown). As discussed above with reference to FIG. 6B, this embodiment can also be created for use with a sheet-fed printer. Four segments of label 33 are marked with indicia "A", "B", "C", and "D" for the purpose of illustration. Each segment is triangular in shape, which sets this design apart from previously discussed embodiments. At the center of label 33 is information focal point 103, which is where the slit 77 begins and is applied along a locus to a corner. The square tractor-fed stock 57 of impressionable substrate 58 may be imprinted with an impact printer. Label 33 is applied in the traditional manner by removing the release backing 53 and exposing the adhesive backing 52 for alignment and then final application. The hidden corner marker 124 is released from label 33 by the perforated line 88.

Figure 12B:
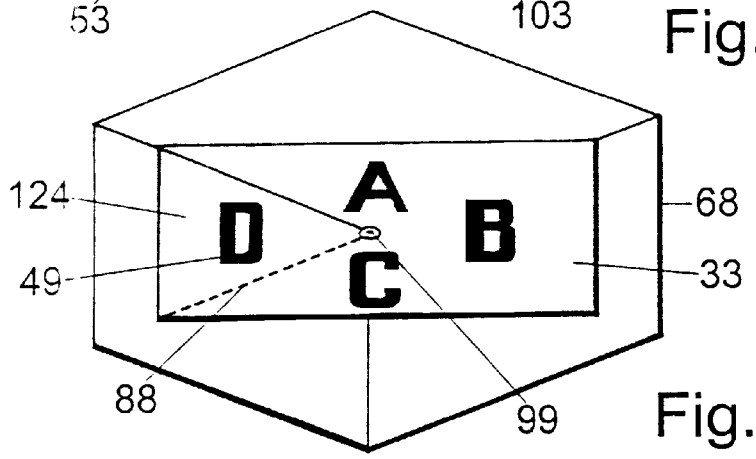
FIG. 12B is a perspective view of the label shown in FIG. 12A aligned on a parcel corner.

FIG. 12B shows a perspective view of the label 33 from FIG. 12A having information focal point 103 in alignment with corner 99 of box parcel 68. Hidden corner marker 124 shown with the indicia "D" is removable along perforation 88. Again, for purposes of illustration, the printed fields of information are represented by the indicia letters "A", "B", "C", and "D" markings in ink 49 in order to demonstrate orientation of the billboard segments.

Figure 12C:
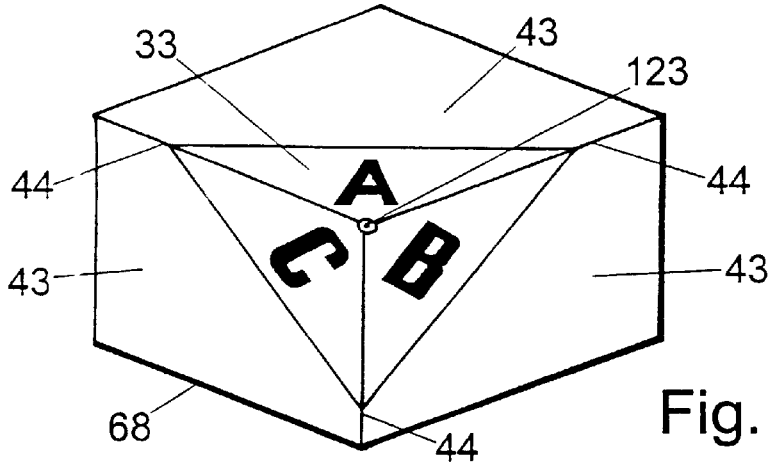
FIG. 12C is a perspective view of the label shown in FIG. 12B applied on the corner of the parcel.
Figure 12D:
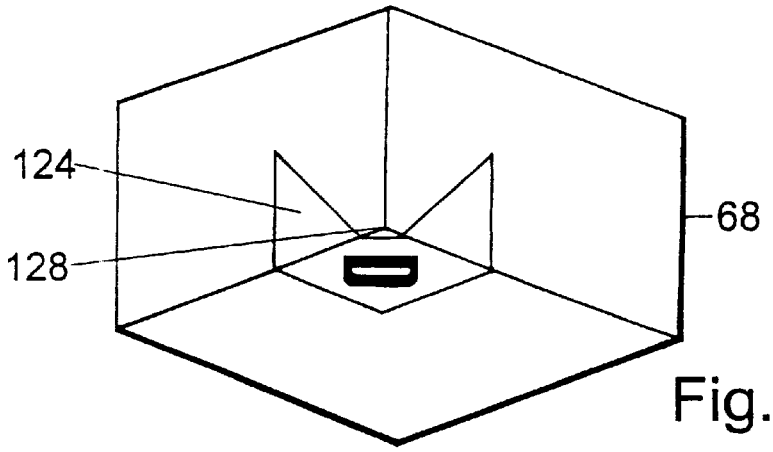
FIG. 12D is a perspective view of a "D" billboard segment from the label shown in FIG. 12B applied to mark the hidden corner of the parcel.

FIG. 12C shows label 33 of FIG. 12B applied to a box parcel 68 having converging edges 44 and the contiguous side panels 43 which form an apex which, with the label 33 applied thereto, can now be considered the information focal point 123 of a parcel.

FIGS. 12D is a perspective view of box parcel 68 from FIG. 12C and shows the use of the "D" billboard as a hidden corner marker 124. By spinning the box parcel 68 around 180° on its lower corner as if it were a vertical axis the "hidden" corner 128 of parcel 68 is shown with the hidden corner marker "D" applied thereto.

Figure 13A:
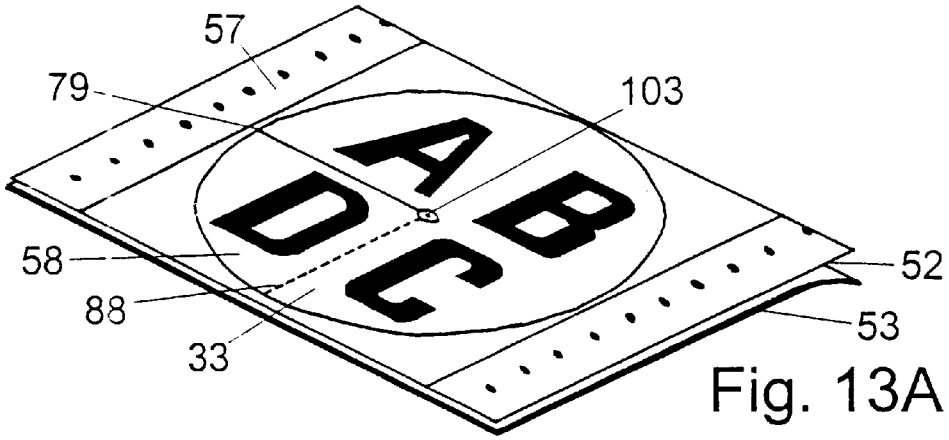
FIG. 13A is a perspective view showing a tractor-fed circular three-dimensional label in accordance with the invention.
Figure 13B:
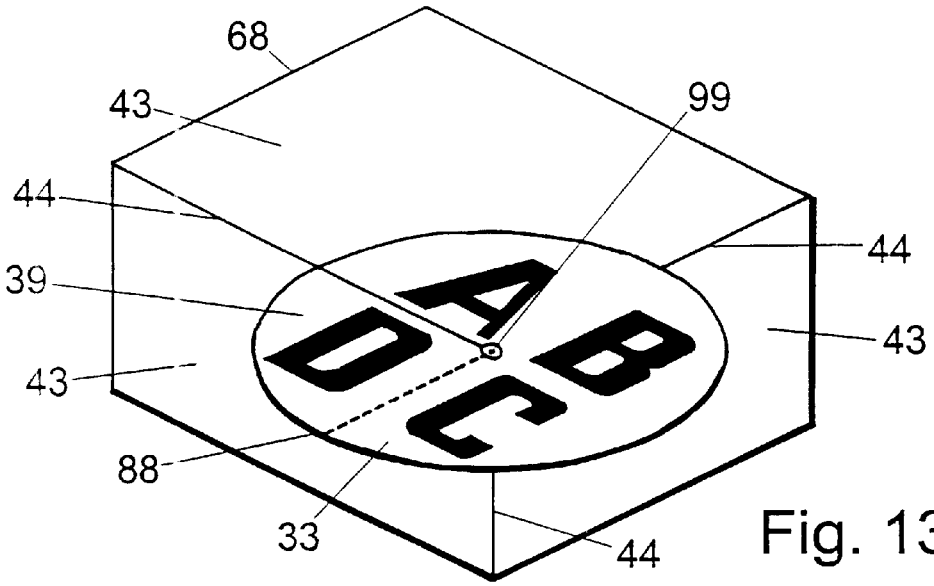
FIG. 13B is a perspective view showing the label of FIG. 13A aligned on a box parcel corner.
Figure 13C:
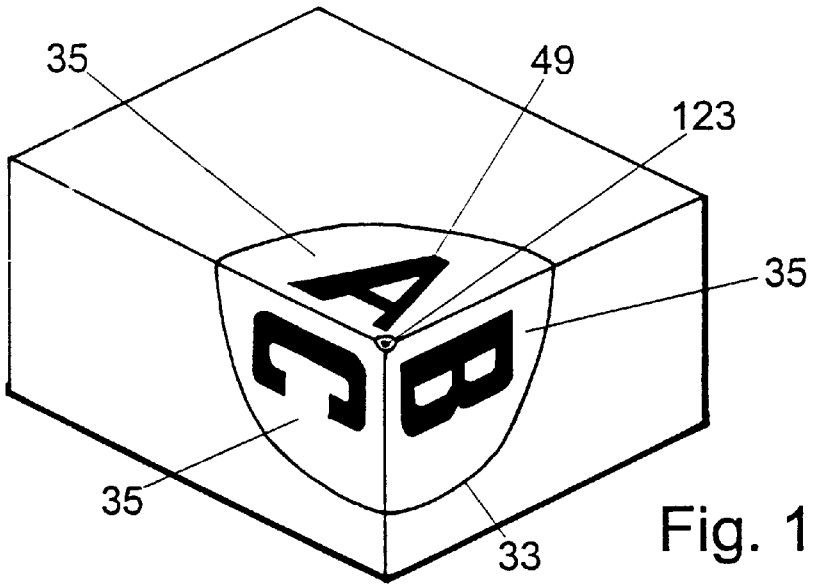
FIG. 13C is a perspective view showing the label of FIG. 13B applied to a box parcel corner.

FIGS. 13A–13C—Circular Label

FIG. 13A–13C illustrate a tenth embodiment comprising a special shape three-dimensional label 33 printed and applied to box parcel 68. Specifically, a circular label 33 provides a pleasing, unique, eye-catching, and balanced display.

FIG. 13A is a perspective view of a circular three-dimensional label 33 having tractor-fed printing capability. Information focal point 103 of label 33 is in the center of the design. Slit 79 is designed to open the face of label 33 and provide for releasing the "D" billboard using perforation 88. Label 33 is constructed of impressionable substrate 58 which may be a paper or recycled paper capable of being printed, embossed, or marked by hand with a writing instrument. Application of the three-dimensional label is achieved by aligning information focal points 103 with chosen corner 99 of parcel 68 and removing the release backing 53 to expose the adhesive 52.

FIG. 13B is a perspective drawing showing label 33 from FIG. 13A removed from its backing and aligned with corner 99 of box parcel 68. As is the case with any of the embodiments disclosed herein, label 33 is applicable to any object having converging edges and contiguous sides, such as an object of merchandise, instead of box parcel 68. Removable billboard 39 segment, shown for illustration purposes as having the indicia "D", is easily removed using perforated line 88.

FIG. 13C is a perspective view of label 33 of FIG. 13B completely applied to box parcel 68. The application shows informational focal point 123 where three of the information billboard segments 35 (shown for illustration purposes as having the indicia "A", "B", and "C") are exposed on parcel 68.

Figure 14A:
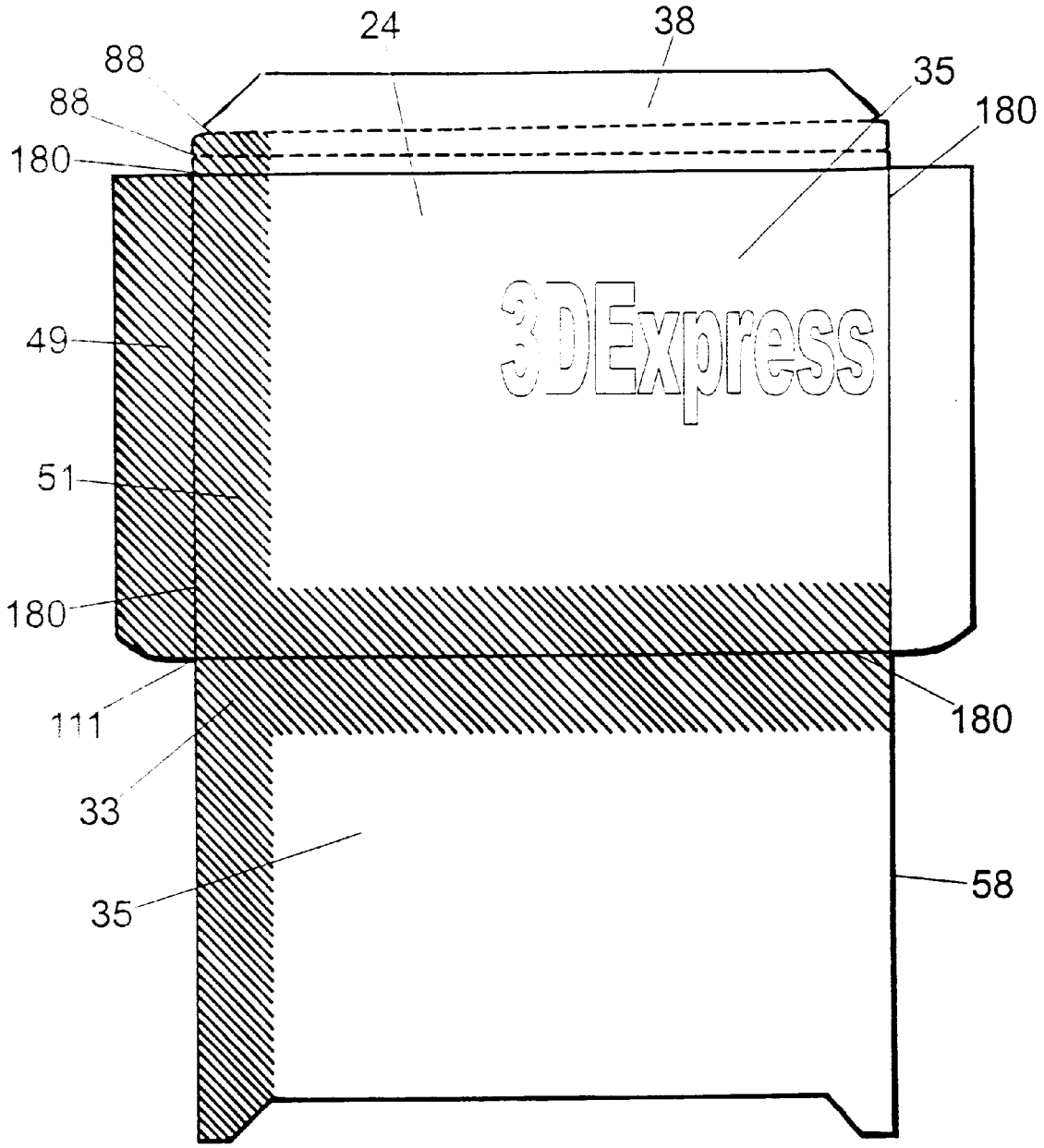
FIG. 14A is a plan view of a three-dimensional label document envelope having a three-dimensional label imprinted directly with ink on a parcel during its manufacture in accordance with the invention.
Figure 14B:
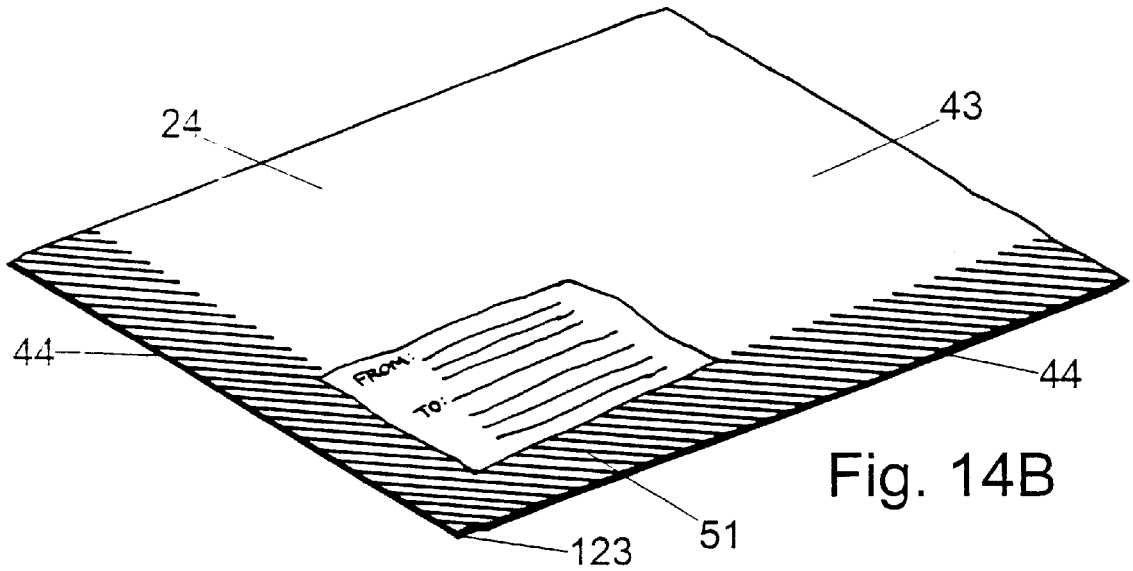
FIG. 14B is a perspective view of the envelope of FIG. 14A showing a traditional label.
Figure 14C:
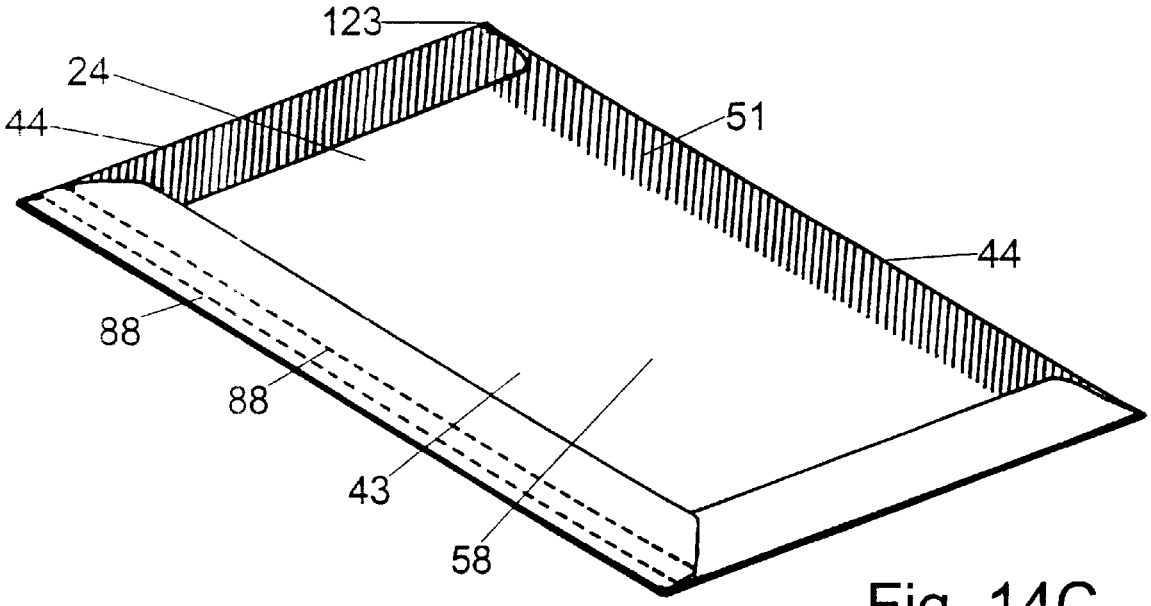
FIG. 14C is a perspective view of the bottom of the envelope of FIG. 14B.

FIGS. 14A–14C—Imprinted Parcel Envelope

FIGS. 14A–14C show how three-dimensional label 33 may be positioned on an envelope by imprinting it directly with ink 49 on impressionable substrate 58. This impression may take the form of an embossment in order to provide a tactile orientation for the visually challenged or to improve speed of sorting parcels.

FIG. 14A is a plan view of an express document envelope 24 having label 33 printed directly on impressionable substrate 58 marked with a color urgency marking 51 code of green ink 49 on the information billboard segment 35 of document envelope 24. 180° folds 180 are made along the perimeter of the top information billboard segment 35 when assembling envelope 24. The top overlapping billboard 38 segment is used to close the document envelope and has two perforated lines 88 and a grip-like tab on each end to provide means to easily open the envelope. Information billboard segments 35 may be provided with copy and artwork as required. The flaps on the left and right of the top information billboard 35 fold 180° along folds 180 to seal the document envelope having a visual information center 111.

FIG. 14B is a perspective view of envelope 24 of FIG. 14A after assembly thereof. The label document envelope is printed with the color urgency marking 51 in ink. These impressions are printed to appear on the converging edges 44 and contiguous side panels 43 of document envelope 24 in order to direct attention to information focal point 123.

FIG. 14C is a bottom perspective view of document envelope of FIG. 14B. The direct printing of the color urgency marking 51 in ink on the impressionable substrate 58 may be enhanced by laminating a lithographed sheet of a printed impressionable substrate 58 applied directly to heavier point board material of the envelope prior to die-cutting and folding it into the finished document envelope 24. The converging edges 44 are marked on the bottom of the side panel 43. Perforated lines 88 may be reinforced with a cord or plastic pull to assure the receiver of the document envelope parcel will be able to open the parcel quickly and easily.

Figure 15A:
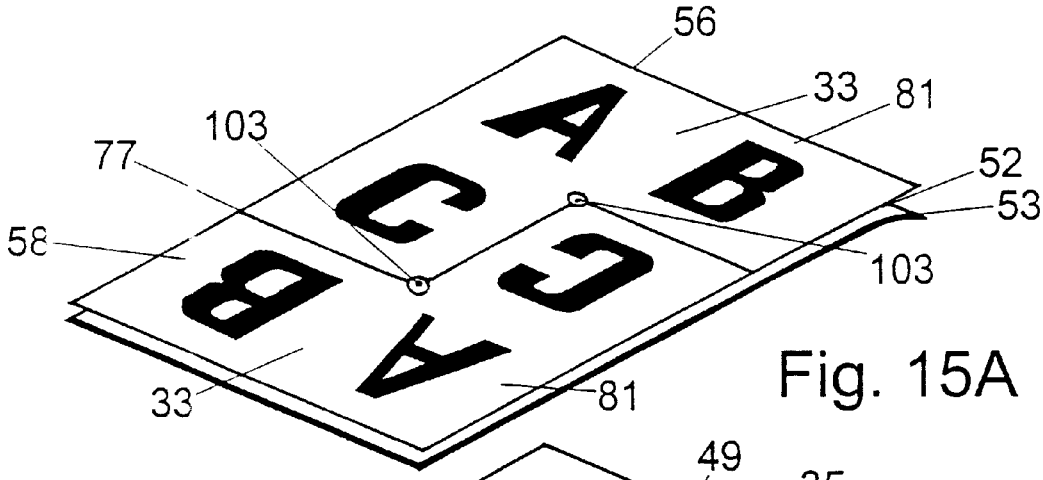
FIG. 15A is a perspective view of a sheet-fed three-dimensional label that may be made from recycled materials in accordance with the invention.
Figure 15B:
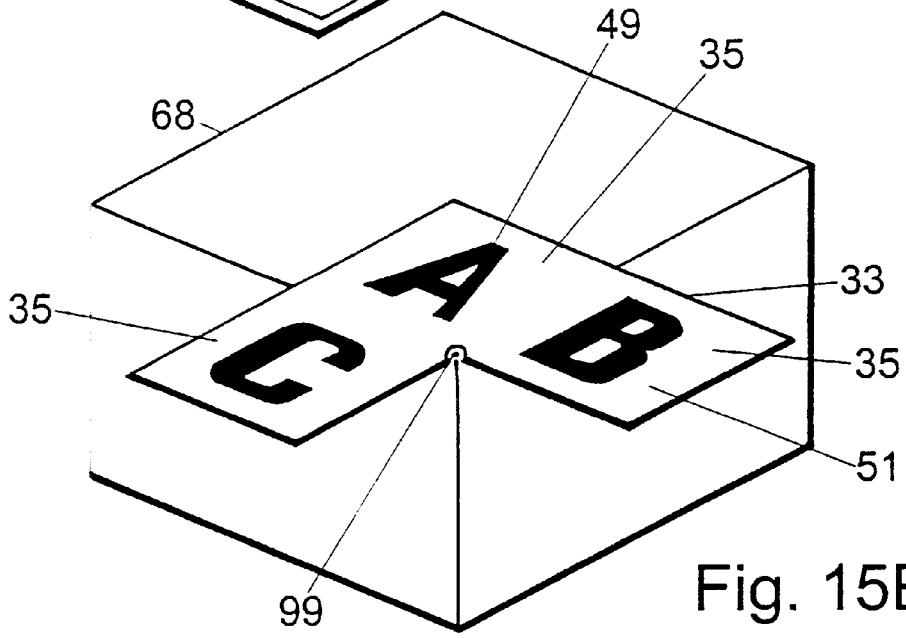
FIG. 15B is a perspective view of the label shown in FIG. 15A aligned on a parcel.
Figure 15C:
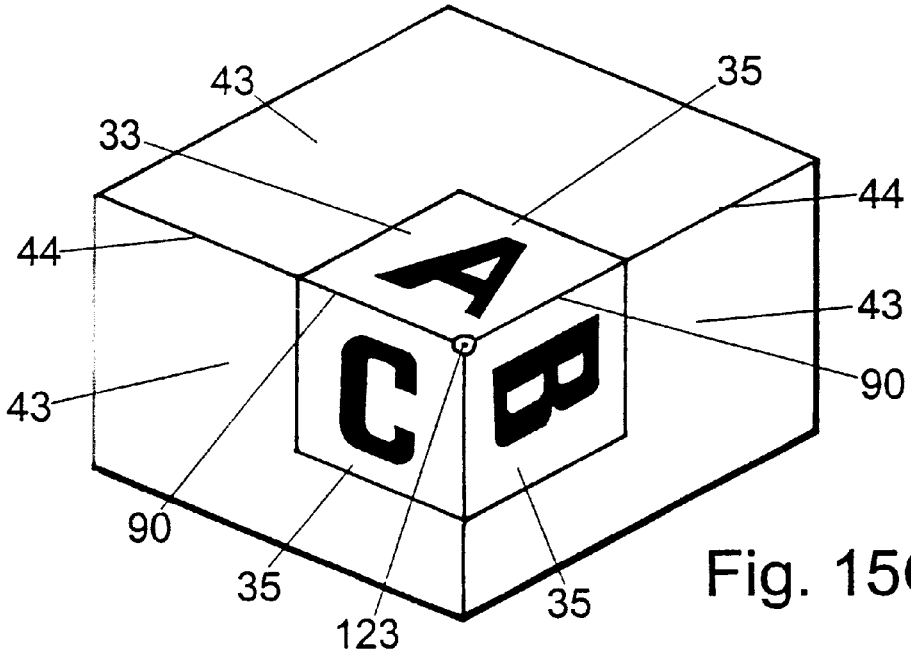
FIG. 15C is a perspective view of the label shown in FIG. 15B applied to the parcel.

FIGS. 15A–15C—Reusable Label

FIGS. 15A–15C show a twelfth embodiment comprising a reusable three-dimensional label 33 made from recycled and/or tear-resistant materials that may be creased and die-cut to fold and wrap about a parcel corner. Marking on label 33 may be achieved by thermal embossing the indicia or Braille for tactile-comprehension and use by the visually challenged. Other printing methods will be apparent to those skilled in the art and may vary with the printing requirements of the user and the impressionable substrate used. "Green-Points" will be awarded for use of recycled materials or use of percentages of recycled material such as old milk bottles collecting at dump sites nationwide. In a warehouse or manufacturing facility these three-dimensional labels 33 may serve to temporarily mark parcels for dating and inventory rotation.

FIG. 15A is a perspective view of a conceptual three-dimensional label 33 that would be reusable and applied to the corners of box parcels. The impressionable substrate 58 is composed of recycled material for temporary but repeated use. The slit 77 provides for two three-dimensional labels 33 that have been die-cut as sections in this embodiment having two three-dimensional labels 33 produced from a single sheet 56 of material. Each three-dimensional label would form an information focal point 103 as shown. The application may be made by removing the release backing 53 to expose the reusable adhesive 52 of this embodiment.

FIG. 15B is a perspective view of one of the labels 33 of FIG. 15A shown aligned on a corner of box parcel 68. The marker billboards 35 may be printed in this example by silk screen printing with an ink 49 matched for use on the substrate or other known method. The material may be color urgency coded 51 for some purpose and need of the customer.

FIG. 15C is a perspective view of label 33 of FIG. 15B completely applied to a box parcel corner showing three information billboard segments 35. The 90° folds 90 may be creased or otherwise weakened in the factory during the die-cutting manufacturing process to permit easy and accurate folds by an individual user. Billboards "B" and "C" may be fused to form the label 33 and applied on contiguous sides 43 and edges 44 to form information focal point 123.

FIGS. 16A–16C and 17—Rigid Label

Figure 16A:
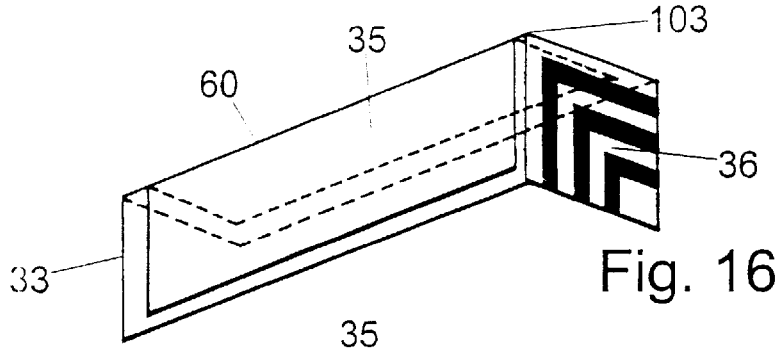
FIG. 16A is a perspective view of the bottom side of a molded three-dimensional label in accordance with the invention.
Figure 16B:
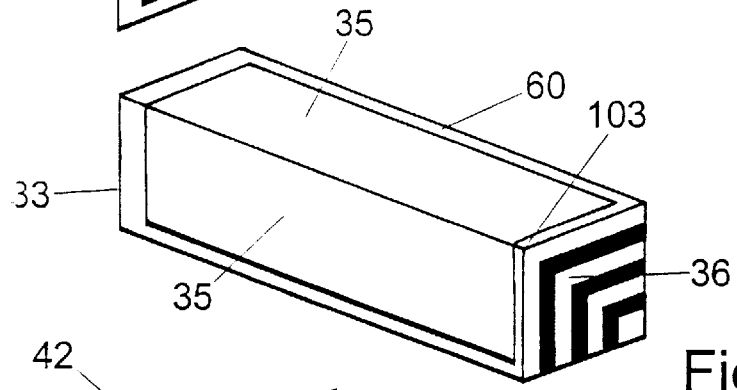
FIG. 16B is a perspective view of the molded three-dimensional label of FIG. 16A showing where a computer printed label may be applied.
Figure 16C:
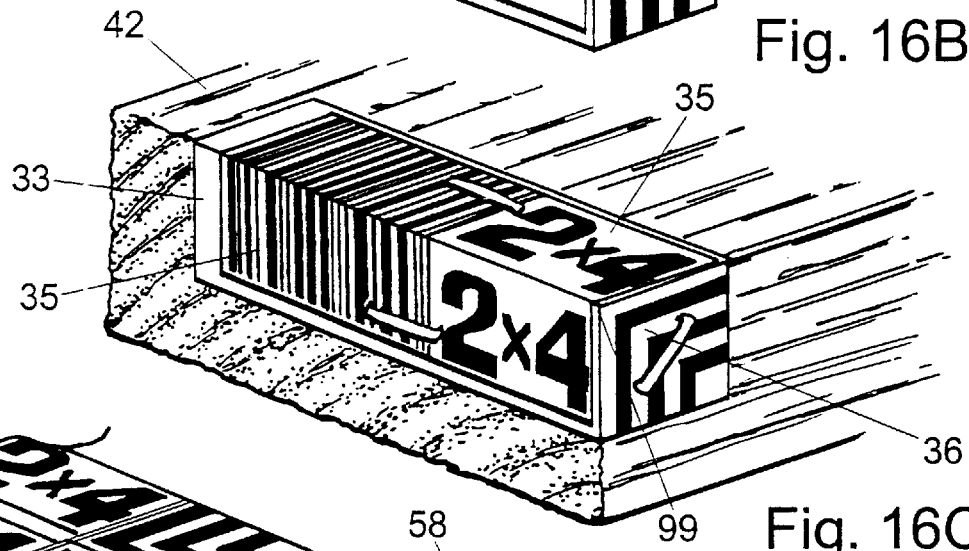
FIG. 16C is a perspective view of the molded three-dimensional label applied to a piece of lumber.

FIGS. 16A–16C show a thirteenth embodiment comprising a molded three-dimensional label 33 for marking a corner of a parcel or merchandise object. This useful in pricing items that are difficult to price such as lumber and makes it easy to find a label when scanning it at the retail checkout.

FIG. 16A is a perspective view showing a bottom view of a molded three-dimensional corner label 60. Merchandise having a corner may need to be identified with an information focal point 103 for purpose of pricing or marking with a bar-code for inventory recognition. Information billboard 35 shown as a blank space may be used to apply an ordinary label of the proper size that will be coordinated to the retail environment. The price and/or Universal Price Code marking is easily found and scanned at the retail register. This expedites the recording of sales data and makes the record of the transaction accurate. The marker billboard 36 segment shown on the end of the molded three-dimensional label 60 is directional in this embodiment having a raised portion shown in dark lines that may be useful as an example of a tactile guide for the visually challenged as well as a visual guide for the sighted to access the bar code for scanning.

FIG. 16B is a perspective view of the top side of label 33 as shown above. Information billboard segments 35 may be applied with an adhesive label for the merchandise it will be attached to. Label 33 is a product itself reusable by means of attaching other bar-code labels as required. Marker billboards 36 are visual and tactile guides to the information focal point 103 of label 33 that has been injected molded as a corner marking device.

FIG. 16C shows label 33 of FIG. 16B as it may be used. Here, staples are used to apply label 33 to a piece of lumber for pricing and inventory tracking. The information billboard segments 35 may be utilized to place a bar-code for inventory and for pricing in the retail environment. Marker billboard segment 36 is molded with raised bars shown in black leading to the information focal point 99 of a merchandise object marked with label 33. The raised bars provide a tactile response to further aid in locating the important information provided on label 33.

Figure 17:
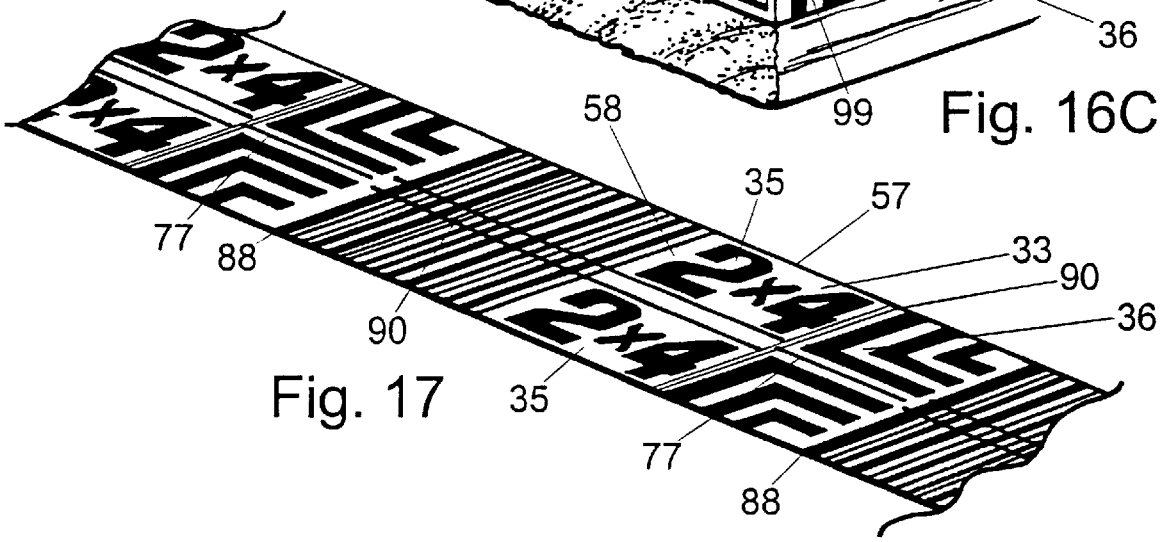
FIG. 17 is a perspective view of a non-adhesive three-dimensional label that may be folded and stapled to apply it to a difficult-to-price article of merchandise in accordance with the invention.

FIG. 17 is a perspective drawing showing three-dimensional labels 33 printed on a continuous strip of an impressionable substrate 58 having slits 77 made parallel to the edges of substrate 58. Perforations 88 allow separation of label 33 from the substrate 58. A crease, or weakened portion 90, is formed in the substrate to allow for easy folding about the edges of the merchandise parcel shown to be a piece of lumber in FIG. 16B. Label 33 has two information billboard segments 35 which may have adhesive but it is not required. For example label 33 may be applied directly with staples, as shown in FIG. 16C by folding it around the corner of the merchandise parcel. Marker billboards 36 are folded to overlap when applied to the merchandise parcel.

FIGS. 18A–18F—Hand or Machine Applied

FIGS. 18A through 18F illustrate a fourteenth embodiment of the invention directed toward labels that can be reliably applied by automated machinery. The hand or machine applied labels are characterized by the information focal point 103 being located along a fifth edge 76 which is at an oblique angle to the perpendicular fold lines 90. The hand or machine label can also be described as having a straight slit that passes through information focal point 103, effectively removing a quadrant of the label. An advantage of the hand or machine applied label is that it is less likely to tear when removing the label from its backing and it requires fewer steps for application. In addition, by locating the focal point anywhere along the fifth edge 76 of label 33, the precision necessary to line up information focal point 103 to corner 99 of box 68 is reduced. These advantages make this design especially suitable for automated application.

Figure 18A:
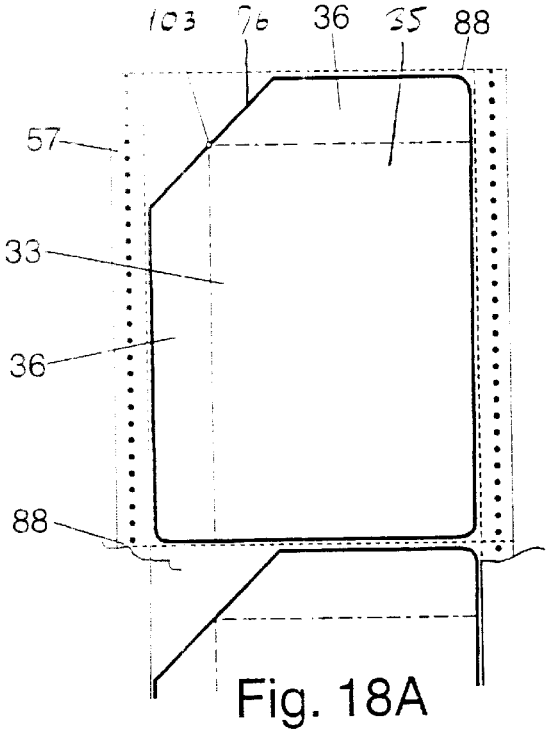
FIG. 18A is a plan view of another embodiment of the invention specifically designed to accommodate automated application.

FIG. 18A shows an example of a hand or machine applied label 33 having fifth edge 76 passing through information focal point 103 of label 33. This label can replace existing conventional shipping labels commonly used in the shipping industry today since the information billboard 35 is the same size as the conventional label (not shown).

Figure 18D:
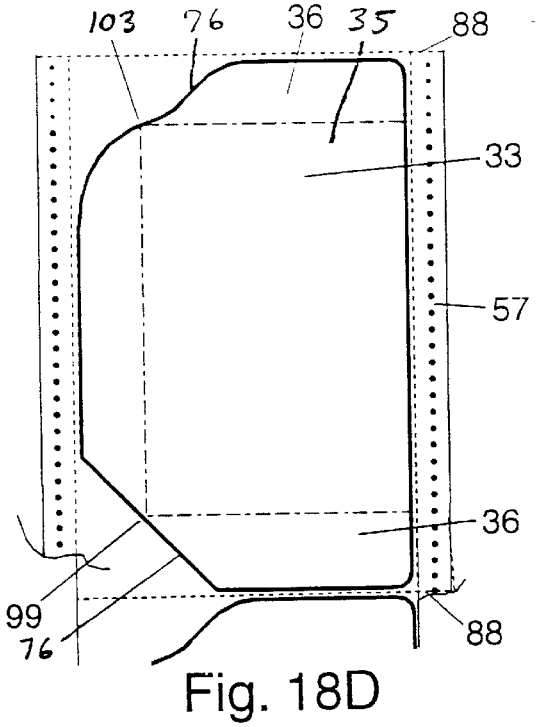
FIG. 18D is a plan view of a six-sided label which has the same benefits as the label shown in FIG. 18A but is also more flexible in its application.
Figure 18B:
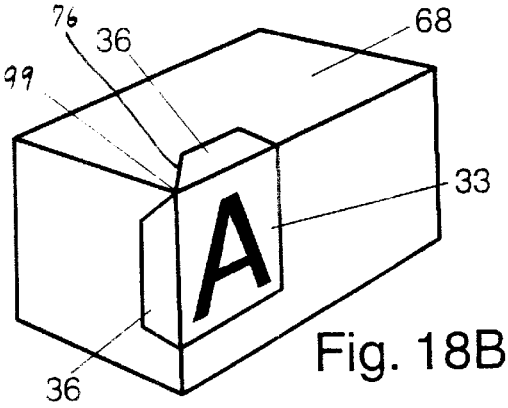
FIG. 18B is a perspective view of the label of FIG. 18A applied to a box parcel.

FIG. 18B shows the label shown in FIG. 18A applied to a box 68. Because of the fifth edge 76 is at an oblique angle to the fold lines 90, after one of the marker billboards 36 is applied to one side of the box, the remaining billboards can be applied to the two other sides of the box adjacent to corner 99 in a single step using a V-shaped roller (not shown) for automated application. This direction of application may be parallel or perpendicular to the print web. The indicia "A" is provided for illustrative purposes only, so that the orientation of the label can be readily understood in subsequent views.

Figure 18E:
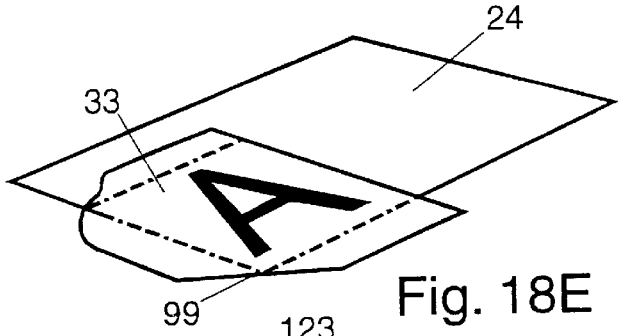
FIG. 18E shows the label of FIG. 18C aligned to the corner of an envelope parcel.
Figure 18C:
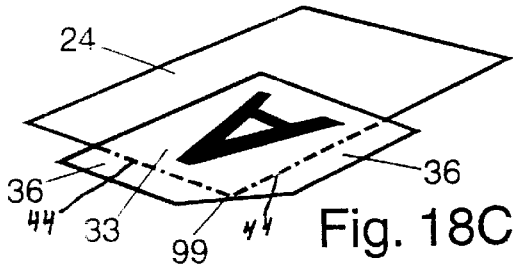
FIG. 18C is a perspective view of the label of FIG. 18A aligned to a parcel envelope.
Figure 18F:
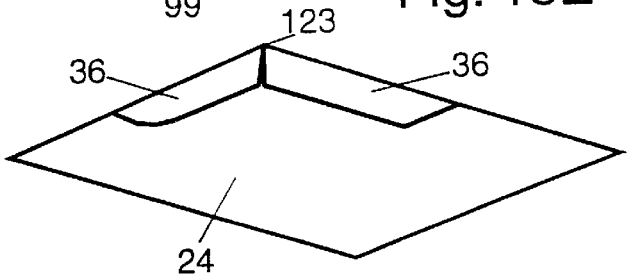
FIG. 18F shows the back of the envelope parcel of FIG. 18D with marker billboards folded over the converging edges of the envelope parcel.

FIG. 18C shows the label shown in FIG. 18A aligned with envelope parcel 24. Marker billboards 36 are folded to the back of envelope parcel 24 along converging edges 44. As seen in FIG. 18F, the marker billboards do not overlap at the corner.

FIG. 18D shows a hand or machine applied label 33 having two generally oblique edges supporting multiple quadrant systems in a manner similar to gyroscopically readable label shown in FIGS. 5A through 5C. The upper-left, generally oblique edge 76 is curved to illustrate one of the possible variations on the design which can be made to satisfy design considerations. The second oblique edge provides for additional locations for an information focal point and increases the flexibility of the design shown in FIG. 18A. Although not shown here, seven and eight sided labels can also be envisioned further increasing the flexibility of the design.

FIG. 18E shows label 33 aligned at corner 99 of parcel envelope 24. All that remains in completing the application of label 33 is folding marker billboards 36 around edge 44 along fold lines 180. This figure demonstrates the advantage of providing the second oblique edge. While the indicia "A" is rotated in FIG. 18C, here, in FIG. 18E, the label can be applied in its correct orientation.

FIG. 18E shows the back of the parcel envelope 24 shown in FIG. 18E with marker billboards 36 folded around edges 44 of envelope 24. Unlike previous embodiments having overlapping marker billboards on the back side of envelope 24, here there is no overlap.

Method According to the Invention

The method of using a three-dimensional parcel label (three-dimensional label) 33 as shown in FIGS. 1A–1C compared with using the traditional address shipping label starts out identically to the initial steps of applying the address information and removing the release backing sheet 53. As with the traditional label, information on label 33 can be hand written or applied by having a computer programmed to print fields of information on the pressure-sensitive adhesive-backed impressionable substrate 58. This impressionable substrate 58 is shown both in tractor-fed (or continuous web-fed) and in sheet-fed designs in FIGS. 6A and 6B, respectively. The label of the traditional style is applied to the surface of the parcel side and smoothed down by burnishing a pressure sensitive label to assure the best adhesion. This is where the method of application of a three-dimensional label according to the invention diverges from the traditional label.

Label 33 is applied by first choosing an appropriate corner for label alignment and application versus choosing a side. Prior to removing the release backing sheet the information focal point 103 is aligned to the chosen corner. To choose a parcel corner is to choose the parcel's information focal point 123. FIG. 1B shows information focal point 103 of label 33 aligned with corner 99 of the box parcel 68. This position can be held with an index finger. Label 33 is then rotated so that a chosen slit 77 is parallel and runs along a converging edge 44 of the parcel as shown in FIG. 1C. Then, label 33 is wrapped around the corner 99 of parcel 68 as shown in FIGS. 1A–1C in an order to get a visual impression as to how a three-dimensional label will fold about a parcel corner. Once the concept of a three-dimensional label is understood, release backing 53 is removed and label 33 is wrapped about contiguous sides 43 and converging edges 44 of corner 99 in a random, clockwise, or counter-clockwise order.

The following steps explain the application of label 33 as shown in FIGS. 1A–1C. However, they are written here to be applicable to the application of the other three-dimensional label designs. Additionally, any prior art with the label applied over two sides is improved because this method of parcel three-dimensional labeling will accelerate finding the information on a parcel.

It is important to observe that the three-dimensional label applies a single billboard onto the surface of a parcel initially with one segment or quarter panel of the three-dimensional label design. The next procedure is to smooth the next segment over a converging edge of the parcel on one or both sides. In the case of the box parcel two 90° folds are made and in the case of the envelope parcel, two 180° folds are made, wrapping the label segments on the contiguous back side of the envelope parcel. However, it is noted that a minimum of three billboard segments may be applied to a parcel having a corner-either a box parcel or an envelope parcel.

Three-dimensional label quick instructions: (1) Choose a parcel corner, (2) align information focal points with forefinger the corner, (3) position and pivot to align label slit on an edge, (4) peel and remove label backing, (5) smooth and wrap billboard segments folding about the corner, and (6) smooth and burnish billboard segments to the parcel.

Conclusion, Scope, and Ramifications

My method of marking a parcel by folding a three-dimensional label, which may have a slit, onto a parcel corner instantly saves time locating information about a parcel. Therefore money is saved in visually engaging parcels having three-dimensional labels by not repeatedly orienting a parcel to access information about it.

While my above description contains many specifics, these should not be construed as limitations on the scope of the invention, but rather as an exemplification of several preferred embodiments. Many other variations are possible, for example, the term "slit" can be interpreted generally to indicate that the cut to be made to an impressionable substrate could be manufactured as a single or multiple slit 77, V-cut section 83, J-cut section 82, slot, die-cut section 81, perforation, micro-perforation, laser cut, steel rule die, die cut space, mark to make a cut, ink printed marking on a parcel during manufacture for a slit, or instruction about where to make a cut as shown in this teaching. Discussion of the locus of points formed along the bisection of a 90° corner of a three-dimensional label should not be limiting as to where the slit must begin. Slit 77 origin and its length can be manipulated to come up with an endless number of combinations of three-dimensional parcel labels 33.

Additionally, the number and sizes of billboards produced per page or material web length utilized for a demonstrated purpose as shown will achieve an economy of allowing more than one or multiple three-dimensional labels 33 per sheet or cut length on a web of label material. The size, purpose, and number of three-dimensional labels having printed or unprinted multiple billboards can be endlessly changed in three ways: First, by not having a predetermined size of a three-dimensional label so it can be designed to meet a user's needs. Second, skewing the information focal point in a T-square like manner scrolling the position of a slit perpendicular to an edge along with it, and third, by shortening the length of the perpendicular center slit away from the center of the three-dimensional label.

The concept of applying a three-dimensional label to a corner avails itself to an endless number of combinations for custom arrangements. By having the three-dimensional label billboard segments produced for specialized needs of an information focal point 123, a parcel marked with such a label will function without discrimination in regard to a predetermined size, color, technique of folding, technique of slitting, shape of slit, length of slit, number of slits, position of slits, embossing, debossing, printed surfaces, graphics, or blank surfaces, and direct everyone to the information focal point 123 on the parcel having a corner marked with the label.

It is important to note that the preferred orientation of a slit is in the horizontal position to prevent snagging of an impact printer's printhead when it rapidly scrolls back and forth across the label. Additionally, marking a parcel with a blank, perhaps smaller colorful three-dimensional label 33 will teach everyone instantly where to locate the posting position for information about a parcels direction and contents. This will become a place where existing inventories of present day label systems and other information may be posted in order to be quickly found during the parcel's lifespan.

This method of marking a box parcel 68 or an envelope parcel 24 with a folding three-dimensional label which may have a slit 77 will provide a highly efficient, safe, yet economical device that can be computer-printed or used in a blank, stock or custom graphic design format with indicia or embossment as tactile guides without having a predetermined size in addition using it to develop custom application for customers. The label may be printed in ink directly on a parcel substrate or applied as a lithographed sheet to the surface of the parcel substrate. Additionally, the label may be molded in plastic material for applications that are not easy to mark with a pressure-sensitive label or directly printed with ink.

Corner marking with a three-dimensional label may be achieved by using simple graphics, colorful graphics, multicolor designs on plain, directly printed on a parcel, or a colored impressionable substrate capable of accepting embossment for use as a tactile guides. Additionally, a corner may be simply marked with a can of spray paint or applied to the parcel by direct printing with stencil, ink-jets, thermal printing, thermal forming, direct printing on the parcel during manufacturing, use of a blank a three-dimensional label, or applied as a lamination on a parcel substrate during its manufacturing to permit higher quality of printing such as a lithographed carton or document envelope.

All possible embodiments or materials according to the invention are not shown in this teaching. However, various features from different embodiments may be mixed and matched, representing the spirit of the invention. Accordingly, the scope of the invention should be determined not by the embodiments illustrated, but by the appended claims and their legal equivalents.

I claim:

1. A method of labeling a parcel on a corner thereof for rapid information recognition for delivery personnel and others using a three dimensional label comprising:

a step of cutting a substrate into a shape which may be formed into a parcel;

a step of choosing only one location on said substrate corresponding to one corner of said parcel to be an information focal point;

a step of marking said substrate from which said parcel is to be constructed in a region adjacent to said information focal point to clearly indicate said one corner as the information focal point;

a step of constructing said parcel from said substrate;

a step of labeling said parcel by placing any indicia comprising directions for delivery of said parcel, urgency of delivery of said parcel, and contents information of said parcel adjacent to said information focal point sufficient to enable said delivery personnel and others to identify a destination for said parcel;

whereby said marking on said corner of said parcel affords rapid recognition for said delivery personnel and others of where said direction, urgency and contents information lies on said parcel.

2. The method set forth in claim 1 wherein said step of marking includes imprinting said substrate directly.

3. The method set forth in claim 1 wherein said step of marking includes embossing said substrate directly.

4. The method set forth in claim 1 wherein said step of marking includes imprinting a laminate and applying said laminate to said substrate.

5. The method set forth in claim 1 wherein said step of marking includes embossing a laminate and applying said laminate to said substrate.

6. The method set forth in claim 1 further including the step of marking a second corner diagonally opposite said one corner with graphical indication that useful information is found at the one corner.

7. The method set forth in claim 1 wherein said step of labeling includes the step of applying a label with such indicia adjacent to said information focal point.

* * * * *